US012022913B2

(12) United States Patent
Boal

(10) Patent No.: US 12,022,913 B2
(45) Date of Patent: Jul. 2, 2024

(54) ADJUSTABLE FOOTWEAR HAVING INTERCHANGEABLE PANELS

(71) Applicant: Kadima Forward Inc., Los Altos, CA (US)

(72) Inventor: Michele Boal, Los Altos, CA (US)

(73) Assignee: Kadima Forward Inc., Los Altos, CA (US)

( * ) Notice: Subject to any disclaimer, the term of this patent is extended or adjusted under 35 U.S.C. 154(b) by 0 days.

(21) Appl. No.: 17/465,797

(22) Filed: Sep. 2, 2021

(65) Prior Publication Data

US 2022/0039508 A1 Feb. 10, 2022

Related U.S. Application Data

(63) Continuation of application No. 16/191,140, filed on Nov. 14, 2018, now abandoned.
(Continued)

(51) Int. Cl.
*A43B 3/24* (2006.01)
*A43B 9/00* (2006.01)
(Continued)

(52) U.S. Cl.
CPC ..... *A43B 3/242* (2013.01); *A43B 3/244* (2013.01); *A43B 9/00* (2013.01); *A43B 23/0295* (2013.01);
(Continued)

(58) Field of Classification Search
CPC ..... A43B 3/24; A43B 3/242; A43B 3/244; A43B 3/0031; A43B 23/081; A43B 23/085
(Continued)

(56) References Cited

U.S. PATENT DOCUMENTS 2,018,510 A 10/1935 Brauer
2,109,884 A 3/1938 Hill
(Continued)

FOREIGN PATENT DOCUMENTS

DE 474839 C 4/1929
DE 2523299 A1 12/1976
(Continued)

OTHER PUBLICATIONS

Boal, Office Action, U.S. Appl. No. 16/191,140, Apr. 28, 2020, 48 pgs.
(Continued)

*Primary Examiner* — Grace Huang
(74) *Attorney, Agent, or Firm* — Morgan, Lewis & Bockius LLP

(57) ABSTRACT

The footwear includes a base having a toe portion, a heel portion opposing the toe portion, a base left and right side, and a bottom surface to engage the ground when worn by a user. The footwear additionally includes a base top surface opposing the base bottom surface, a toe box permanently coupled to the toe portion of the base at the top surface, and a counter permanently coupled to the heel portion of the base at the top surface. The footwear further includes a left and right support structure permanently coupled to the top surface of the base between the toe box and the counter on each side of the base, and a detachable left and right panel configured to detachably connect to the respective left and right support structure.

23 Claims, 25 Drawing Sheets

Related U.S. Application Data

(60) Provisional application No. 62/586,763, filed on Nov. 15, 2017.

(51) Int. Cl.

| | |
|---|---|
| ***A43B 23/02*** | (2006.01) |
| ***A43B 23/08*** | (2006.01) |
| ***A43C 11/06*** | (2006.01) |
| ***A43C 11/08*** | (2006.01) |
| *A43C 5/00* | (2006.01) |

(52) U.S. Cl.
CPC ..... *A43B 23/081* (2013.01); *A43B 23/088* (2013.01); *A43C 11/06* (2013.01); *A43C 11/08* (2013.01); *A43C 5/00* (2013.01)

(58) Field of Classification Search
USPC ..... 36/100, 101, 132, 136
See application file for complete search history.

(56) References Cited

U.S. PATENT DOCUMENTS

| | | | | | |
|---|---|---|---|---|---|
| 2,519,108 | A * | 8/1950 | Bryant | A43B 3/24 | 36/12 |
| 3,032,896 | A * | 5/1962 | Weaver | A43B 1/0027 | 36/101 |
| 3,114,982 | A * | 12/1963 | McGowan | A43B 3/0031 | D2/905 |
| 3,583,080 | A | 6/1971 | Wagner | | |
| 3,994,080 | A | 11/1976 | Flanagan | | |
| 4,257,177 | A | 3/1981 | Unsted | | |
| 4,342,159 | A | 8/1982 | Edwards | | |
| 4,377,042 | A | 3/1983 | Bauer | | |
| 4,428,129 | A | 1/1984 | Jones | | |
| 5,065,531 | A * | 11/1991 | Prestridge | A43B 23/0245 | 36/15 |
| 5,337,491 | A * | 8/1994 | Mascotte | A43B 3/16 | 36/7.1 R |
| 5,570,523 | A | 11/1996 | Lin | | |
| 5,778,564 | A | 7/1998 | Kettner | | |
| 5,848,484 | A | 12/1998 | Dupree | | |
| 6,775,932 | B2 | 8/2004 | Lin | | |
| 6,895,694 | B2 | 5/2005 | Nye | | |
| RE38,774 | E | 8/2005 | Davis | | |
| 7,171,768 | B2 | 2/2007 | Klein | | |
| 7,204,043 | B2 * | 4/2007 | Kilgore | A43B 23/042 | 36/105 |
| 7,331,123 | B2 | 2/2008 | Workman | | |
| 7,614,165 | B2 | 11/2009 | Curry | | |
| 7,698,834 | B1 * | 4/2010 | Courville | A43B 3/103 | 36/15 |
| 7,748,145 | B2 | 7/2010 | Jones | | |
| 7,802,381 | B2 | 9/2010 | Condie | | |
| 8,316,563 | B2 | 11/2012 | Wegner | | |
| 8,413,351 | B1 * | 4/2013 | Watters | A43B 3/16 | 36/7.1 R |
| 8,904,675 | B2 | 12/2014 | Koch | | |
| 8,950,087 | B2 * | 2/2015 | Baucom | A43C 11/1493 | 36/89 |
| 10,561,196 | B2 | 2/2020 | Schindler | | |
| 10,786,044 | B2 * | 9/2020 | Burch | A43B 13/14 | |
| 11,234,480 | B2 * | 2/2022 | Thomasson | A43B 3/244 | |
| 11,350,698 | B2 * | 6/2022 | Fogarty | A43B 23/222 | |
| 11,457,687 | B2 * | 10/2022 | Kundani Kumta | A43B 3/246 | |
| 2003/0200676 | A1 | 10/2003 | Gross | | |
| 2005/0268496 | A1 * | 12/2005 | Bruce | A43B 3/24 | 36/101 |
| 2007/0074425 | A1 | 4/2007 | Leong | | |
| 2008/0022558 | A1 | 1/2008 | Kaufer | | |
| 2008/0098623 | A1 * | 5/2008 | Komitau | A43B 3/244 | 36/101 |
| 2012/0167419 | A1 | 7/2012 | Park | | |
| 2014/0053431 | A1 | 2/2014 | Euresti | | |
| 2016/0143386 | A1 * | 5/2016 | Cone | A43B 13/223 | 36/7.1 R |
| 2016/0213096 | A1 * | 7/2016 | Borel | A43B 23/027 | |
| 2016/0242505 | A1 * | 8/2016 | Waatti | A43B 23/0215 | |
| 2018/0317608 | A1 * | 11/2018 | Fenato | A43B 13/32 | |
| 2019/0223554 | A1 | 7/2019 | Osborn | | |
| 2020/0229541 | A1 | 7/2020 | Berberian | | |

FOREIGN PATENT DOCUMENTS

| | | | | |
|---|---|---|---|---|
| DE | 3935714 | A1 | 5/1990 | |
| EP | 3127446 | A1 | 2/2017 | |
| FR | 1319820 | A | 3/1963 | |
| FR | 3007627 | A1 | 1/2015 | |
| GB | 1045809 | A | 10/1966 | |
| WO | WO-02071880 | A1 * | 9/2002 | A43B 3/101 |
| WO | WO2008/018888 | A1 | 2/2008 | |
| WO | WO2012/066363 | A1 | 5/2012 | |

OTHER PUBLICATIONS

Boal, Final Office Action, U.S. Appl. No. 16/191,140, Aug. 21, 2020, 49 pgs.

Boal, Office Action, U.S. Appl. No. 16/191,140, Mar. 2, 2021, 35 pgs.

Kadima Forward Inc., International Search Report and Written Opinion, PCT/US2018/061237, Mar. 13, 2019, 11 pgs.

Kadima Forward Inc., Examination Report, EP18816352.1, Mar. 3, 2023, 6 pgs.

* cited by examiner

ADJUSTABLE FOOTWEAR HAVING INTERCHANGEABLE PANELS

This application is a continuation of U.S. application Ser. No. 16/191,140, filed Nov. 14, 2018, entitled "Adjustable Footwear Having Interchangeable Panels," which claims priority to U.S. Provisional Patent Application No. 62/586,763, filed Nov. 15, 2017, entitled, "Adjustable Footwear Having Interchangeable Panels," which are hereby incorporated by reference in their entirety.

TECHNICAL FIELD

This application relates generally to footwear having interchangeable panels or wings that can be easily altered to change the look of the footwear.

BACKGROUND

Specific footwear, like shoes or sandals, are often worn for a particular look or occasion. Wearers typically own numerous pairs of footwear for various uses, looks, or occasions. For example, as part of her work wear, a woman may own three pairs of high heels and three pairs of flat shoes. Additionally, she may own numerous pairs of shoes for particular uses (e.g., running shoes, dancing shoes, casual shoes, walking shoes). Owning multiple pairs of shoes is costly, requires adequate storage space, and inefficient especially when space is at a premium, such as when traveling.

Footwear having a single outer color, pattern (e.g., animal print), or material (e.g., leather) also limits the clothing choices that can be worn with the footwear e.g., the style may be compromised or stifled with a single or only a few limited options.

Accordingly, there is a demand for footwear that solves the need for flexibility while addressing the drawbacks discussed above. The present footwear invention addresses the above drawbacks by providing interchangeable panels or wings that makes it easy to alter the style of the footwear; allowing the wearer to easily move throughout each day and night's activities.

SUMMARY

In accordance with some embodiments, the footwear includes a base having a toe portion, a heel portion opposing the toe portion, a base left side and a base right side opposing the left side. Additionally, the base includes a base bottom surface configured to engage the ground when worn by a wearer (e.g., user) and a base top surface opposing the base bottom surface. The base further includes a toe box permanently coupled to the toe portion of the base at the top surface, a counter permanently coupled to the heel portion of the base at the top surface, a left support structure permanently coupled to the top surface of the base between the toe box and the counter at the base left side, and a right support structure permanently coupled to the top surface of the base between the toe box and the counter at the base right side. The footwear additionally includes a detachable left panel configured to detachably connect to the left support structure and a detachable right panel configured to detachably connect to the right support structure.

In some embodiments, the detachable left panel includes one or more connectors. In some embodiments, the detachable right panel includes one or more connectors.

In some embodiments, the one or more connectors of the detachable right and/or left panel are snap fasteners, hook and eye connectors, and/or hook and loop connectors.

In some embodiments, the right support structure permanently coupled to the top surface of the base is integrally formed with the counter and the toe box. In some embodiments, the right support structure permanently coupled to the top surface of the base is integrally formed with one or more of the counter and the toe box.

In some embodiments, the left support structure permanently coupled to the top surface of the base is integrally formed with the counter and the toe box. In some embodiments, the left support structure permanently coupled to the top surface of the base is integrally formed with one or more of the counter and the toe box.

In some embodiments, the detachable left panel and the detachable right panel include a plurality of eyelets configured to receive shoe laces there through.

In some embodiments, shoe laces are to be woven through the plurality of eyelets to connect the detachable left panel and the detachable right panel together.

In some embodiments, the left support structure and the right support structure includes female connectors embedded within the respective support structure.

In some embodiments, the detachable left panel and the detachable right panel includes male connectors embedded within the structure to detachably connect to the left and right support structure.

In some embodiments, the left support structure includes female connectors embedded within the structure and the right support structure includes male connectors embedded within the structure.

In some embodiments, detachable left panel includes male connectors embedded within the structure, the detachable right panel includes female connectors embedded within the structure, and both the left and right detachable panels are configured to detachably connect to the left and right support structure, respectively.

In some embodiments, the detachable left panel and the detachable right panel are configured to connect to each other. In some embodiments, the detachable left panel and the detachable right panel are configured to connect to each other via respective embedded connection mechanisms. In some embodiments, the detachable left panel and the detachable right panel are configured to connect to each other via shoe lace.

In some embodiments, the base and the detachable left and right panels are of the same material.

In some embodiments, the base and the detachable left and right panels are not of the same material.

In some embodiments, the base and the detachable left and right panels are of the same pattern.

In some embodiments, the base and the detachable left and right panels are not of the same pattern.

In accordance with some embodiments, a detachable footwear apparatus, includes a first panel configured to cover a left support structure having one or more connection mechanisms, a second panel configured to cover a right support structure having one or more connection mechanisms, and a shoelace to couple the first and second panel together.

In accordance with some embodiments, a method includes attaching a first detachable panel to a corresponding first side of a shoe using one or more of a first set of connection mechanisms embedded within the first side of the detachable panel and a first set of receiving connection mechanisms embedded within the first side of the shoe. The method further comprises attaching a second detachable panel to a corresponding second side of the shoe, distinct from the first side of the shoe, using one or more of a second set of connection mechanisms embedded within the second detachable panel and a second set of receiving connection mechanisms embedded within the second side of the shoe.

BRIEF DESCRIPTION OF THE DRAWINGS

For a better understanding of the various described embodiments, reference should be made to the Description of Embodiments below, in conjunction with the following drawings in which like reference numerals refer to corresponding parts throughout the figures.

DETAILED DESCRIPTION

Figure 1:
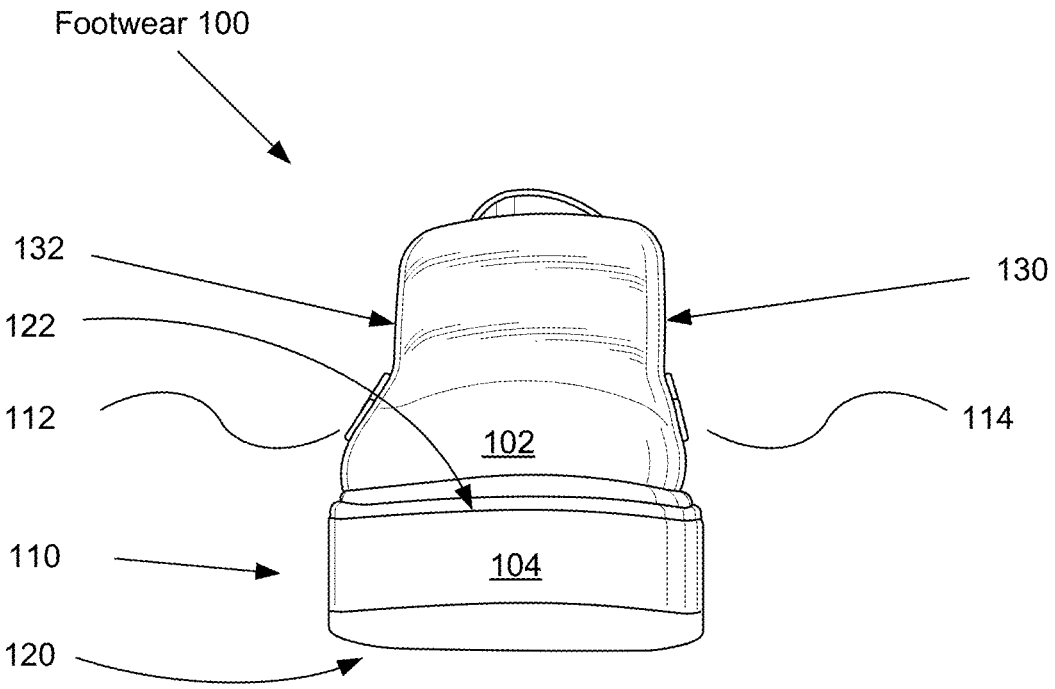
FIGS. 1-3 and 4A-4C illustrate an exemplary right shoe configured to receive detachable panels in accordance with some embodiments.

As explained in the background section above, footwear wearers often require several different styles of shoes for various outfits while traveling or going from work to evening activities. The demand for more flexibility in women's shoes has become a critical piece in simplifying how every woman moves forward each day. Therefore, it is highly desirable to have a single pair of shoes that is not only comfortable, but has the ability to take on many style options simply by switching the interchangeable panels/wings.

To address this need, the present invention describes adjustable footwear having detachably interchangeable panels that customize and adjust the look of a base pair of shoes. The detachably interchangeable and/or detachable panels allow the wearer to change her entire look by simply changing the panels on the shoes. Multiple detachably interchangeable panels/wings can easily be stored in a small travel pouch and put in a suitcase, carry-on luggage, or backpack while taking up minimal space.

The present footwear invention enables a wearer to step out of her safety zone when she normally purchases basic shoe colors (blue, black and brown), and instead allows her to mix things up with new patterns and textures just by easily changing the interchangeable panels. This also creates an opportunity for wearers to mix and match outfits more easily.

The present footwear invention also creates a way to simplify packing for travel, whether for business, pleasure or a combination of both. A wearer can pack one or two pairs of shoes, but still have many style options by taking along a few interchangeable panels that take up less room. This footwear also becomes a wearer's solution to move easily from day related activities into evening events.

Additionally, the present invention is eco-friendly and saves costs by allowing multiple style options with one pair of shoes. The footwear is more versatile in both use and style and eliminates the wearer's need to purchase multiple pairs of shoes, freeing up storage space which is always in high demand.

Reference will now be made to various embodiments, examples of which are illustrated in the accompanying drawings. In the following description, numerous specific details are set forth in order to provide an understanding of the various described embodiments. However, it will be apparent to one of ordinary skill in the art that the various described embodiments may be practiced without these specific details. In other instances, well-known methods, procedures, and components have not been described in detail so as not to unnecessarily obscure aspects of the embodiments.

It will also be understood that, although the terms first, second, etc. are, in some instances, used herein to describe various elements, these elements should not be limited by these terms. These terms are used only to distinguish one element from another. For example, a first detachable panel could be termed a second detachable panel, and, similarly, a second detachable panel could be termed a first detachable panel, without departing from the scope of the various described embodiments. The first detachable panel and the second detachable panel are both detachable panels, but they are not the same detachable panel.

The terminology used in the description of the various embodiments described herein is used for the purpose of describing the embodiments and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, steps, operations, elements, and/or components, but do not preclude the presence or addition of one or more other features, integers, steps, operations, elements, components, and/or groups thereof. The term "exemplary" is used herein in the sense of "serving as an example, instance, or illustration" and not in the sense of "representing the best of its kind."

Figure 2:
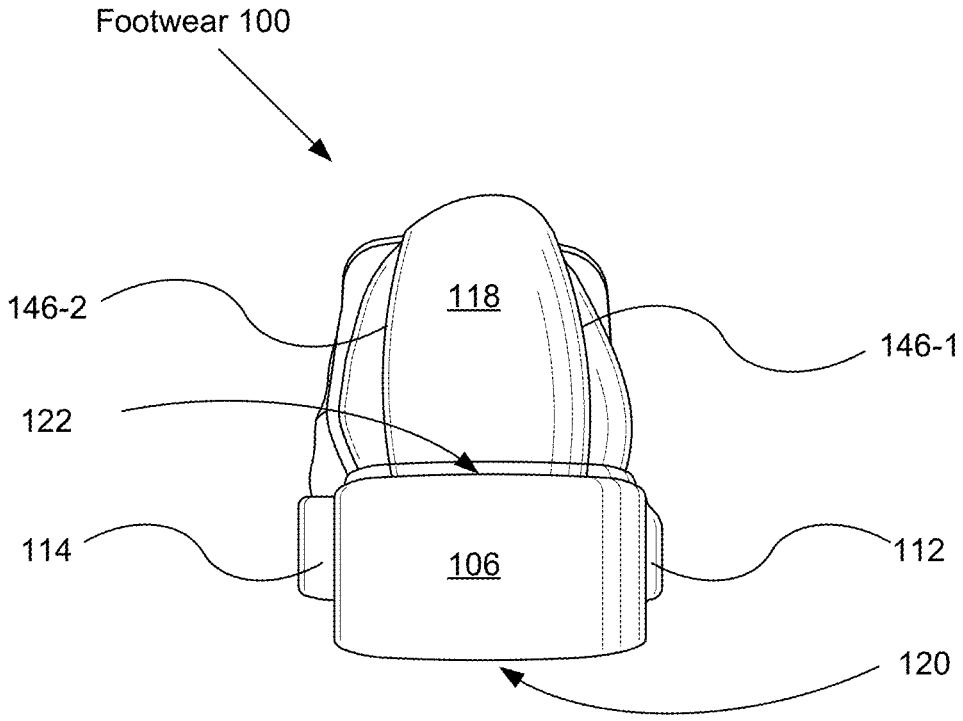
Figure 3:
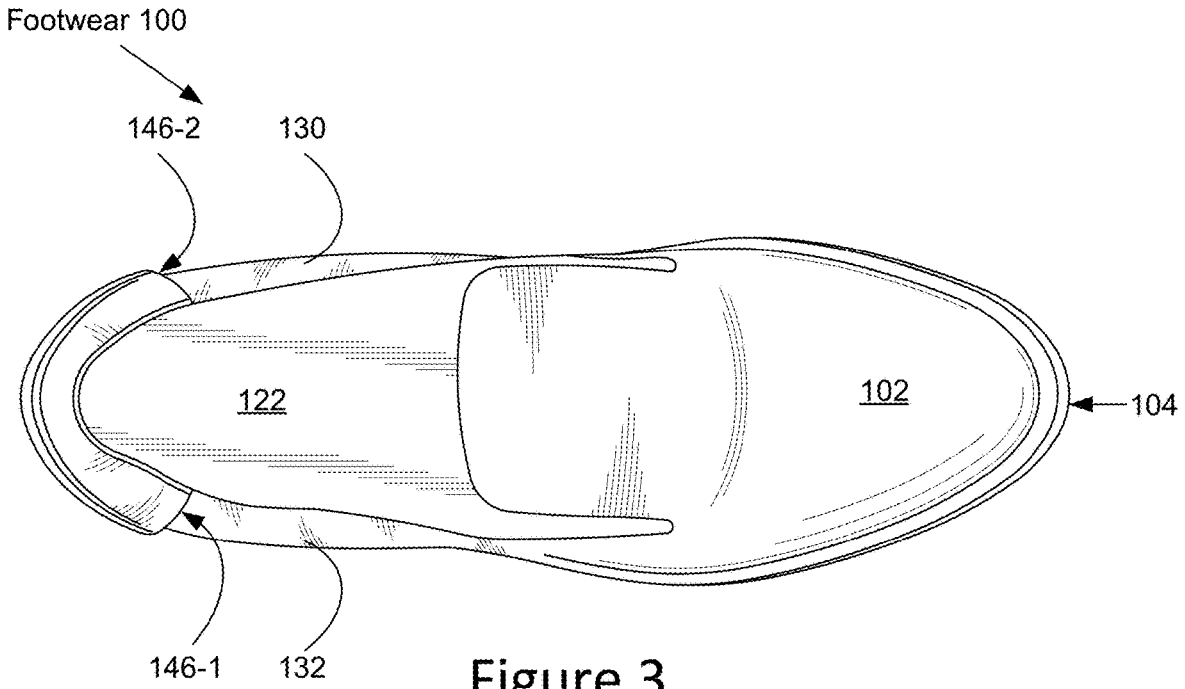

FIGS. 1-4C illustrate exemplary underlying or supporting base footwear without any panels attached to the footwear in accordance with some embodiments. As used herein, footwear refers to any shoe, boot, sandal, slip-on, or other item to be worn on a wearer's foot or feet. While only the right shoe is show in the figures, it should be appreciated that a corresponding left footwear includes the same features of the right shoe. FIGS. 1-4C illustrate front, rear, top, and right sides, respectively of the footwear for a wearer's right foot. The underlying supporting footwear is configured to secure detachable panels that detachably couple to the footwear (e.g., are detachably interchangeable) in accordance with some embodiments. FIGS. 1-3 illustrates a view of the footwear 100 comprising a base 110 having a toe portion 104, a heel portion 106, a base left side 114, a base right side 112, a base bottom 120, a base top surface 122, a toe box 102, a counter 118, a left support structure 130, and a right support structure 132 in accordance with some embodiments.

A base often includes the sole of the shoe which may be made from leather, plastic, rubber, or other suitable material for footwear. The toe portion 104 and the heel portion 106 are substantially opposite each other on the longitudinal axis of the footwear base 110. The base left side 114 and the base right side 112 support the wearer's foot on the left and right side, respectively. The base left and right sides 114, 112 may be made from leather, cotton, canvas, plastic, rubber, velvet, or other suitable material for footwear. The base bottom 120 (e.g., sole of the shoe) typically contacts the ground when worn by the wearer. The base top surface 122 (e.g., footbed, insole) is to contact the bottom of the wearer's foot when worn. The base top surface 122 may be made of memory foam or other material suitable for footwear. The toe box 102 cover the wearer's toes and may be made of the same material as the counter 118 which covers the wearer's heel and/or ankle area. The toe box 102 and the counter 118 may be made from leather, plastic, rubber, or other suitable material for footwear.

In some embodiments, as illustrated for the footwear 100 in FIG. 3, the right support structure 132 is permanently coupled to the top surface of the base (e.g., base top surface 122). In some embodiments, the right support structure 132 is integrally formed with the counter 118 and/or the toe box 102. In some embodiments, the right support structure 132 is permanently coupled to the top surface of the base 122. In some embodiments, the right support structure 132 is integrally formed with one or more of the counter 118 and the toe box 102. As used herein, integrally formed means to be connected or formed together to look and function substantially as a singular unit.

In some embodiments, the left support structure 130 is permanently coupled to the top surface of the base 122. In some embodiments, the left support structure 130 is integrally formed with the counter and the toe box. In some embodiments, the left support structure 130 is permanently coupled to the top surface of the base 122. In some embodiments, the left support structure 130 is integrally formed with one or more of the counter 118 and the toe box 102.

In some embodiments, the toe box 102 and counter 118 are made of the same material on the outer surface thereof. For example, the toe box and counter have a black leather outer surface. In some embodiments, the underlying shoe can be worn on its own (e.g., the toe box, counter, right and left support structures are all of the same color and/or design).

Figure 6:
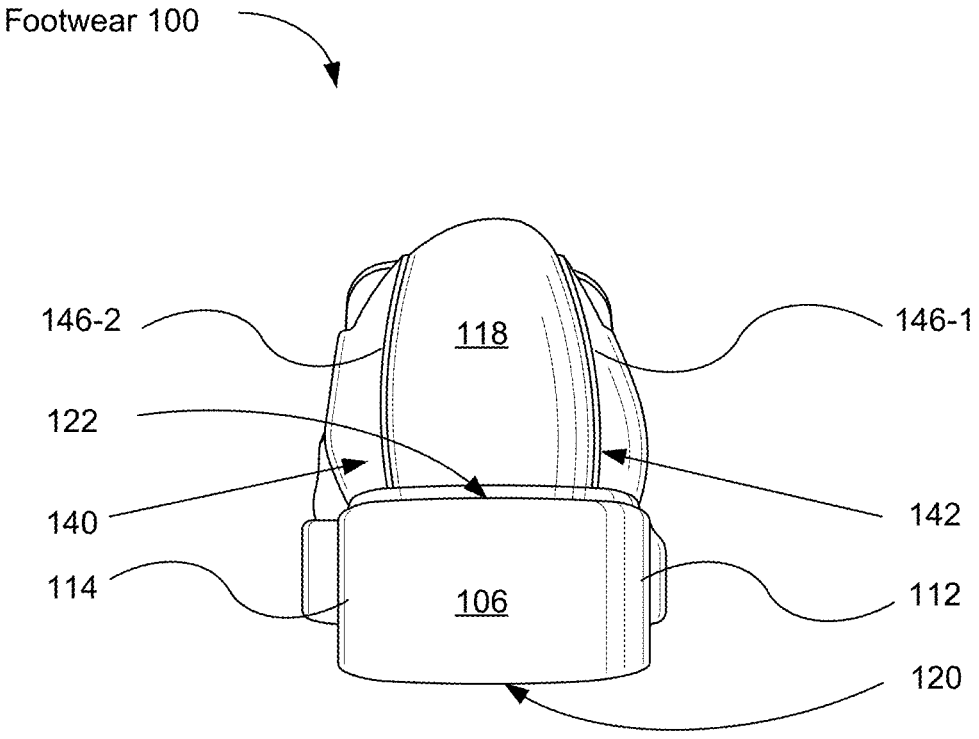

In some embodiments, the counter 106 includes slots 146-1, 146-2 as shown in FIGS. 2 and 6, configured to receive the rear portions of the detachable panels 1000 (FIG. 9) wherein in some embodiments, slides a portion of the detachable panels 1000 into the counter 118 for a seamless fit. For example, the detachable panels 1000 slide into slots 146-1 and 146-2 in FIG. 6. In some embodiments, the toe box 102 is configured with slots 156-1, 156-2 (not shown) to allow the detachable panel 1000 to slide a second portion of the detachable panel 1000 into the slots in the toe box 102.

Figure 4A:
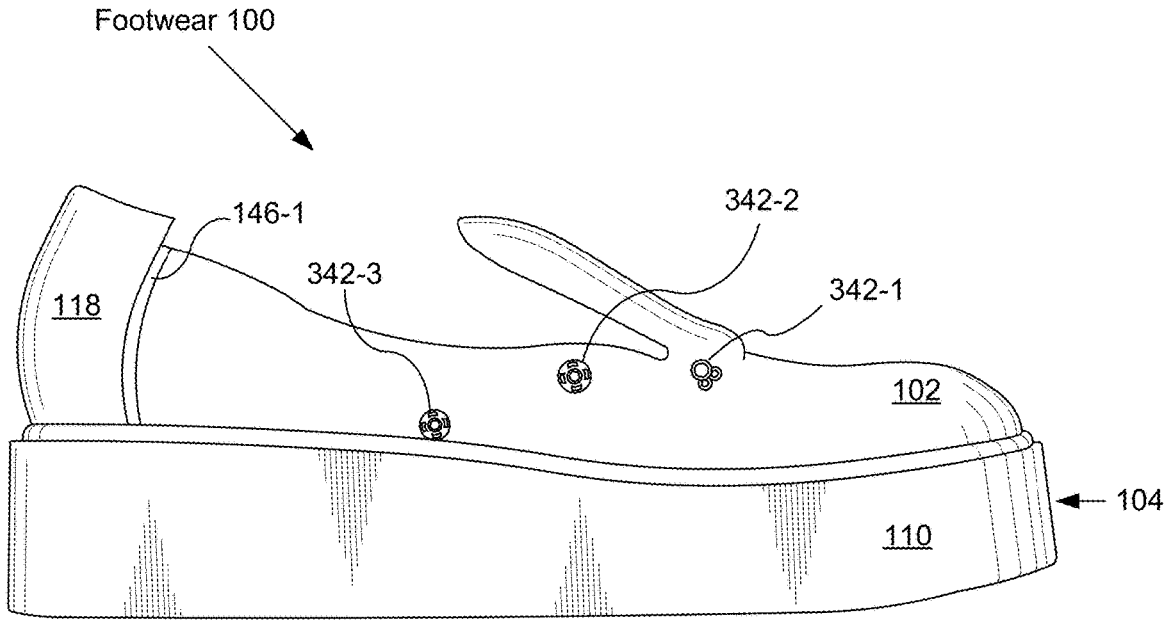
Figure 4B:
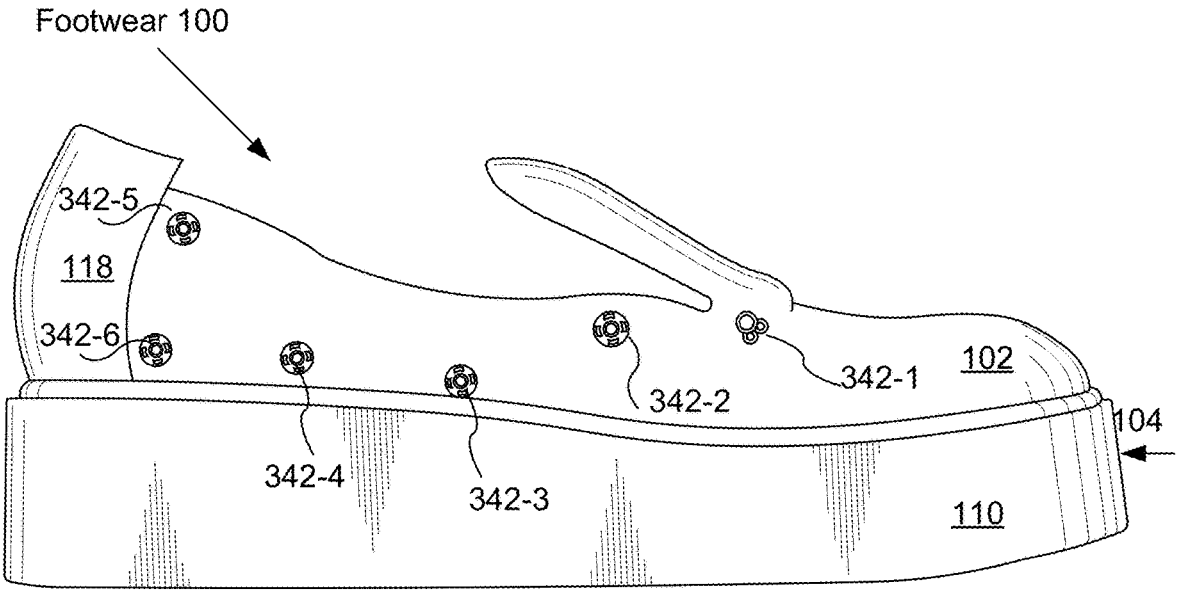
Figure 4C:
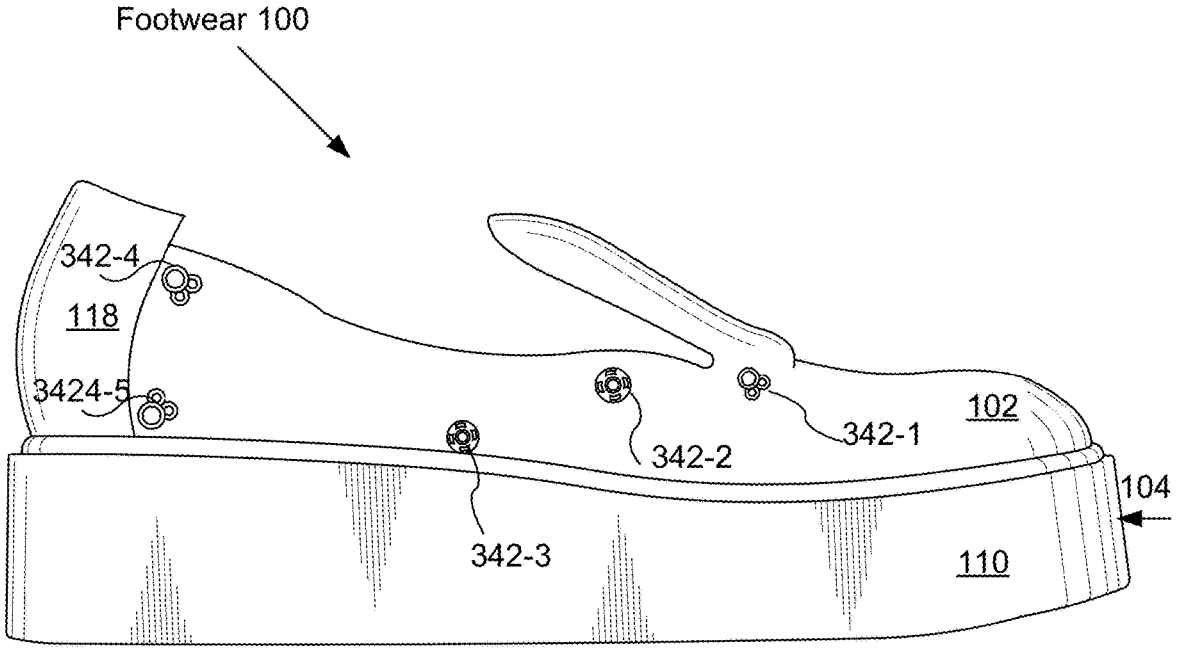

FIGS. 4A-4C illustrate exemplary footwear configured to receive detachable panels, i.e., without the panels attached, in accordance with some embodiments. FIG. 4A illustrates footwear 100 having a slot 146-1 and connectors or connection mechanisms 342. In some embodiments, connection mechanism 342 is a hook-and-loop connection or a snap connector, although any suitable detachable connector may be used. In some embodiments, a slot 146-1 is provided to connect a panel to the shoe, as described below. As shown throughout, the size and location of the connection mechanisms so long as they support the detachably connected panels to the footwear. In some embodiments, these connection mechanisms are placed around the perimeter of where the panel connects to the shoe, and corresponding or complementary connection mechanisms are coupled to each panel. In some embodiments, described below, some connection mechanisms are placed within the slots 146.

Although FIGS. 4A-4C show the right side of the right shoe, a person having ordinary skill in the art would appreciate the other side (e.g., left side of the right shoe, right and left sides of the left shoe) is substantially similar to the right side of the right shoe.

In some embodiments, the counter 118 includes longitudinal slots from a substantially top portion of the counter to a substantially bottom portion of the counter wherein the slots are situated on both a left and right side of the counter.

In some embodiments, the detachable left panel 140 is configured to slide a portion of the detachable left panel 140 into the left longitudinal slot, and the detachable right panel 142 is configured to slide a portion of the detachable right panel 142 into the right longitudinal slot.

FIG. 4B illustrates footwear 100 having several connection mechanisms 342-1 through 342-6. In some embodiments, connection mechanism or connectors 342-1 is a hook-and-loop connection and connectors 342-2 through 342-6 are snap connectors.

FIG. 4C illustrates footwear 100 having several connection mechanisms 342-1 through 342-5. In some embodiments, connection mechanism 342-1 is a hook-and-loop connector and connection mechanisms 342-2 and 342-3 are snap connectors, and 342-4, 342-5 are hook-and loop-connectors. The locations and numbers of the connection mechanisms are not meant to be limiting. A person having ordinary skill in the art can easily add or subtract connectors depending on the size, weight, and shape of the shoe and the detachable panels.

Figure 5:
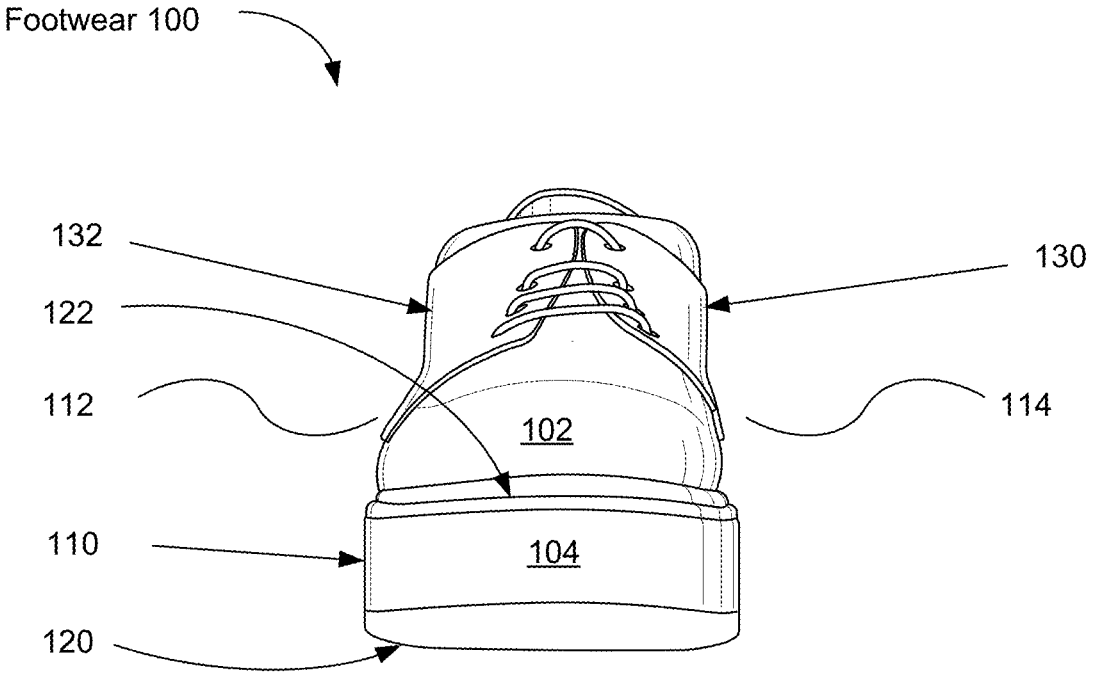
FIGS. 5, 6, 7A-7D, 8A-8D illustrate the exemplary right shoe of FIGS. 1-4C but here with the detachable panels attached to the shoe in accordance with some embodiments.

FIGS. 5-8D illustrate the exemplary footwear of FIGS. 1-4C here showing detachable panels attached to the footwear in accordance with some embodiments. FIG. 5 illustrates the footwear 100 comprising the base 110 having a toe portion 104, the heel portion 106, the base left side 114, the base right side 112, the base bottom surface 120, the base top surface 122, the toe box 102, the counter 118, the left support structure 130, the right support structure 132, the detachable left panel 140, and the detachable right panel 142 in accordance with some embodiments. In some embodiments, there are two panels (e.g., detachable left panel and detachable right panel) connected by laces.

In some embodiments, the one or more left and right panel connectors 240-1, 240-2, **240-*n*, 242-1, 242-2, 242-*n*, the one or more complementary left and right panel connectors 340-1, 340-2, 340-*n*, 342-1, 342-2, 342-*n***, are selected from a group of snap fasteners, hook and eye connectors, and hook-and-loop connectors. The number of connection mechanisms and their placement on the left and right panels are not meant to be limiting.

Figure 8A:
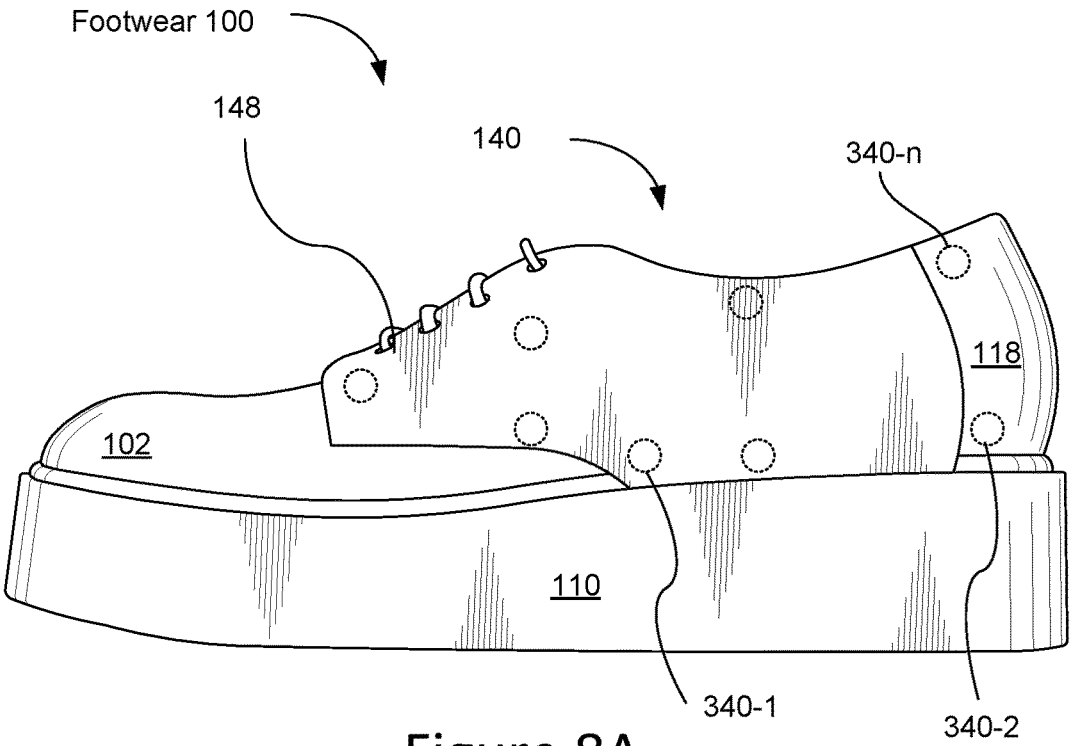
Figure 8B:
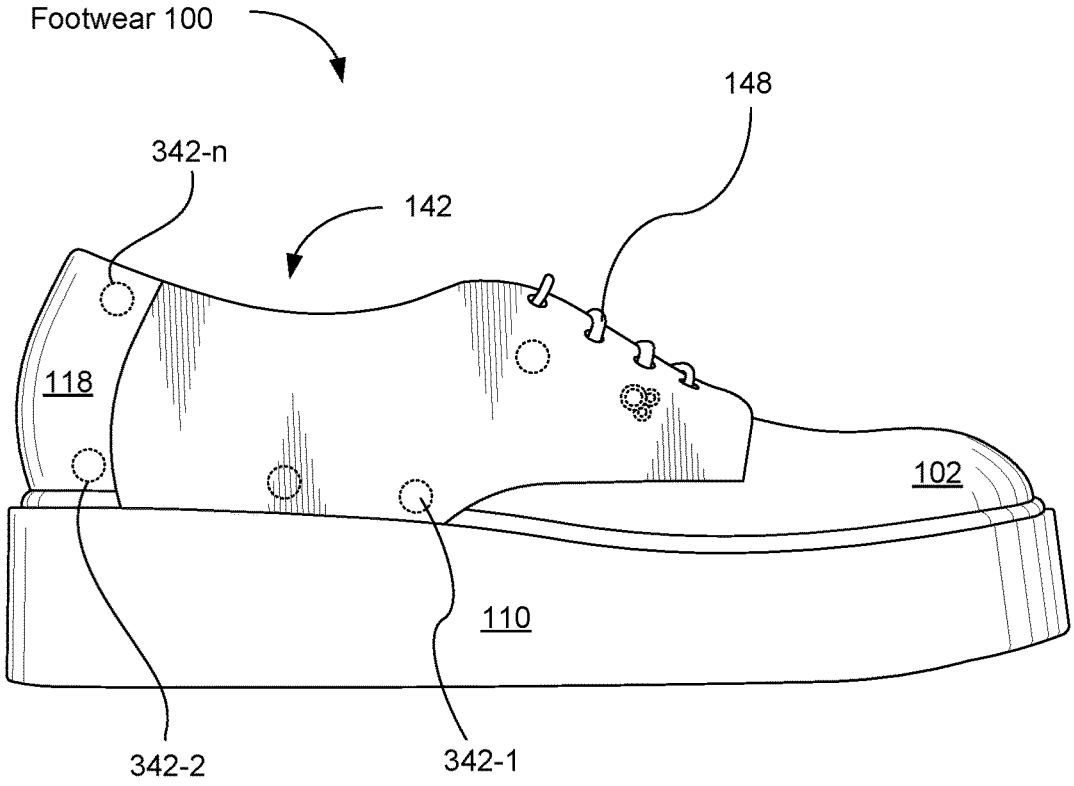
Figure 8C:
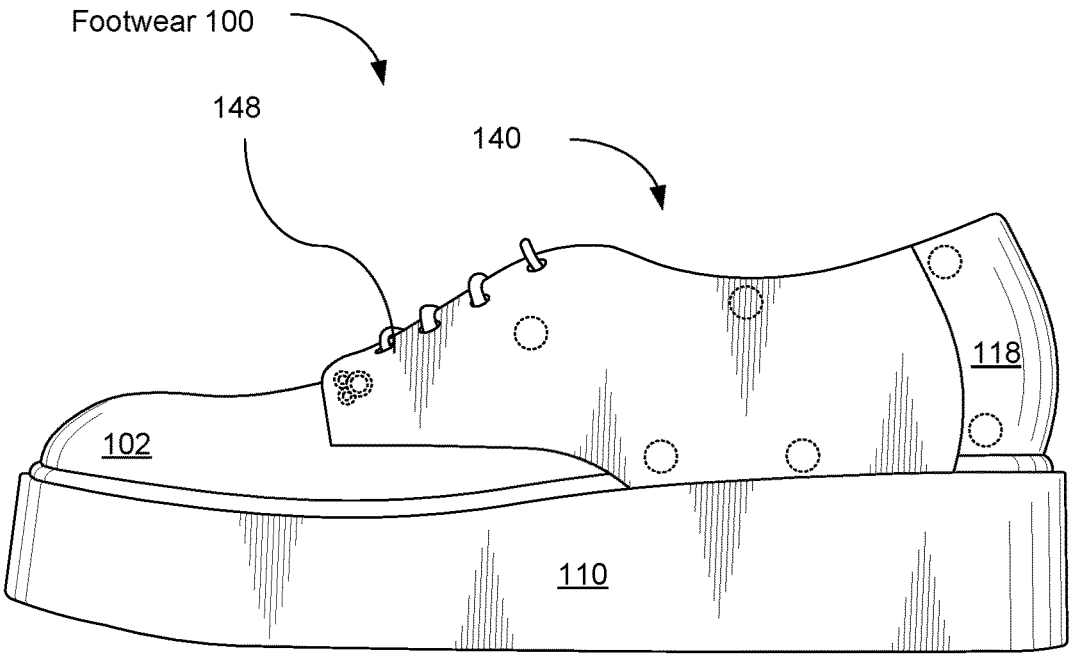
Figure 8D:
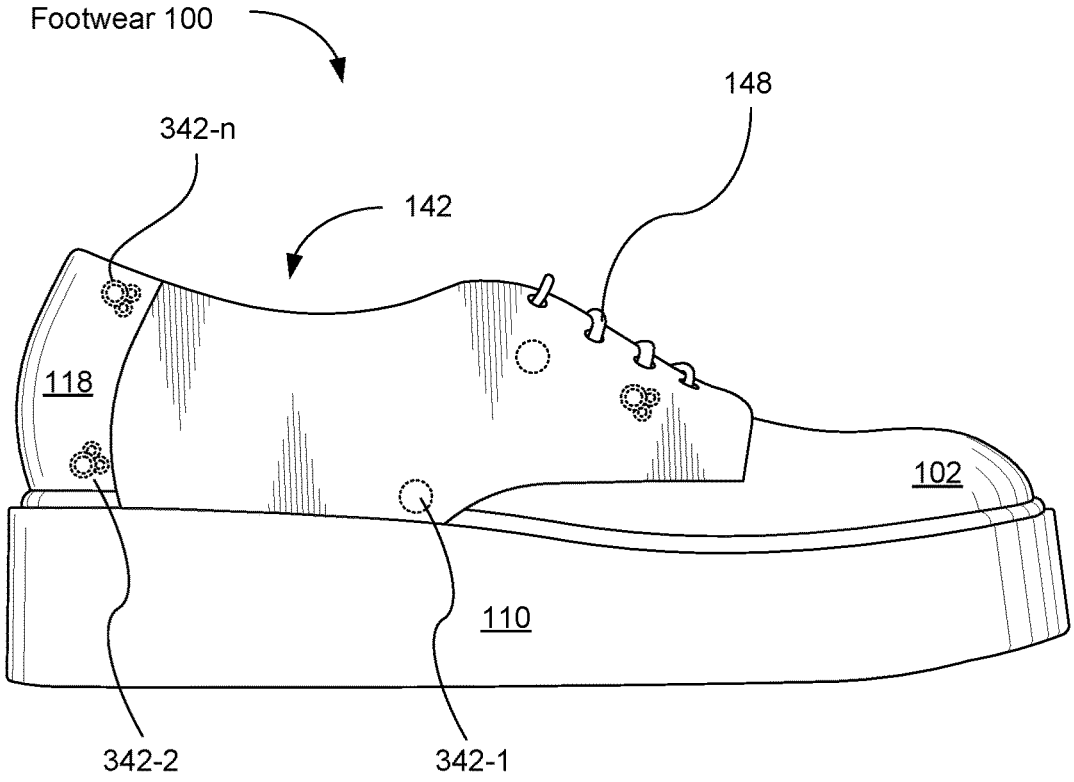
Figure 10A:
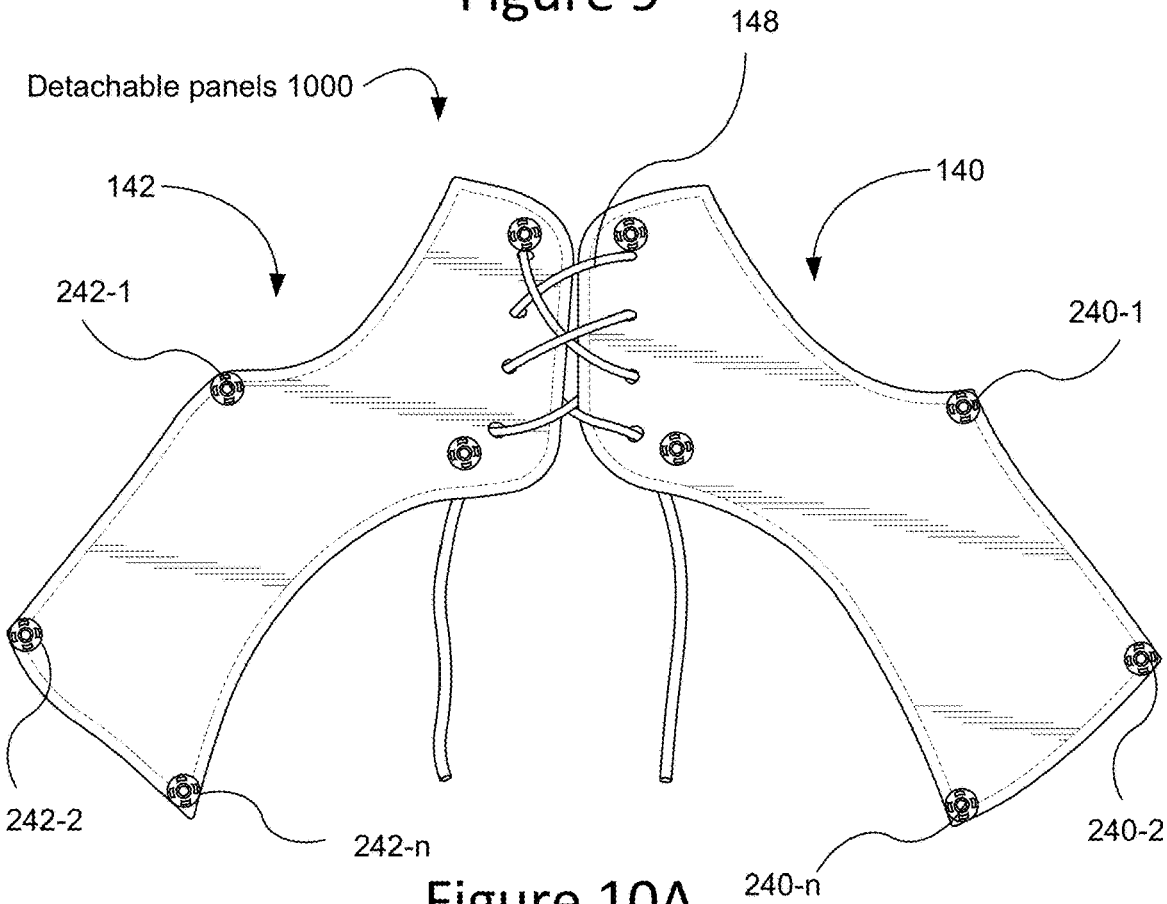
Figure 10B:
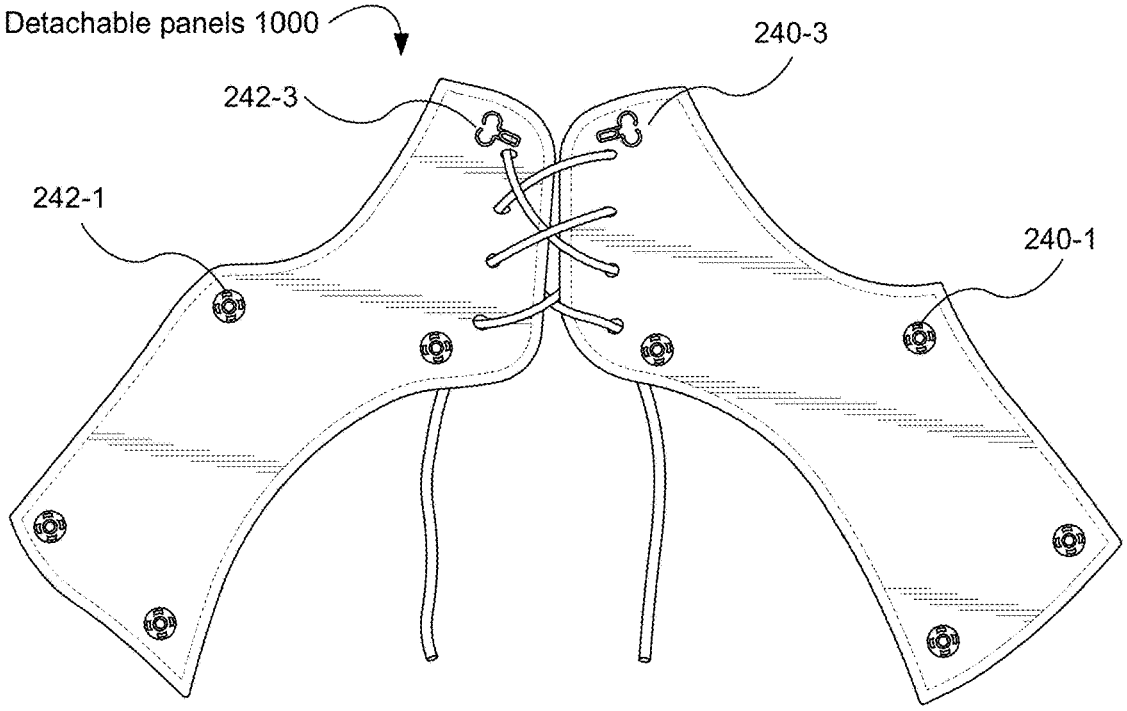
Figure 10C:
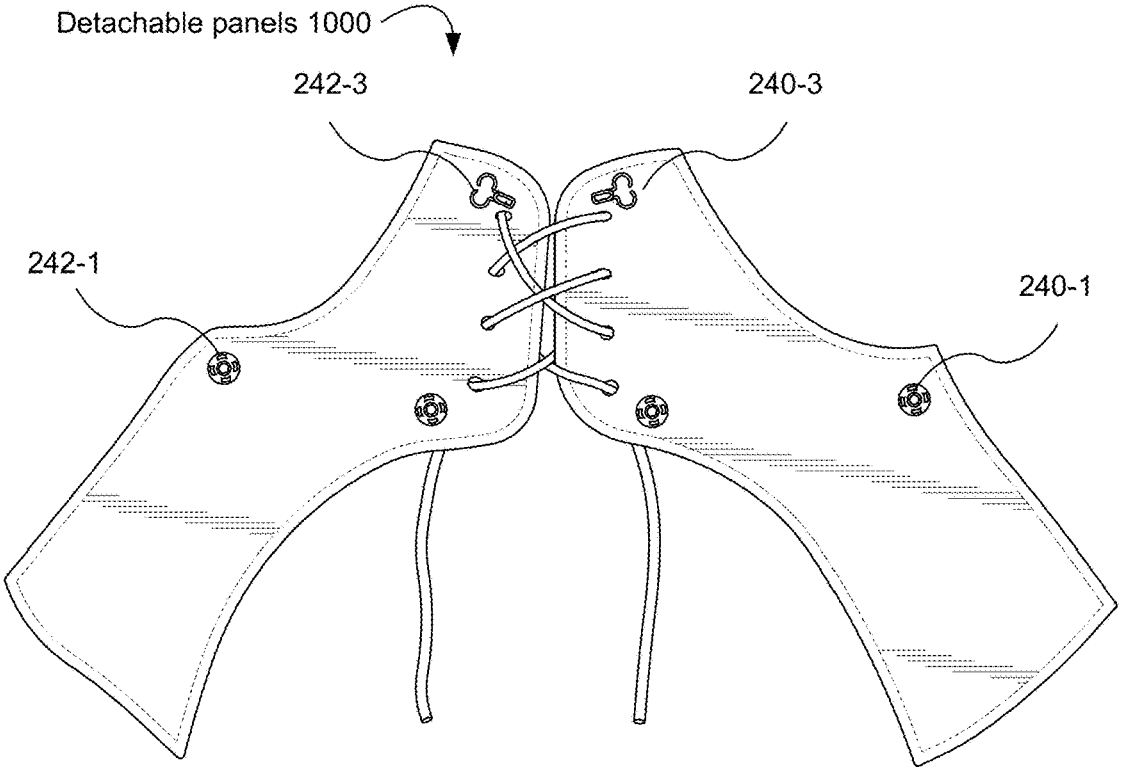

In some embodiments, the detachable left panel 140 configured to detachably connect to the left support structure 130 has one or more left panel connectors 240-1, 240-2, **240-*n* as shown in FIG. 10A. The connectors can be embedded flush with the support structure (e.g., left support structure 130, right support structure 132, detachable right panel 142, detachable left panel 140) to minimize the appearance and obviousness of the connectors. Additionally, the connectors can be male or female. The preferred combination is to have female connectors on the left and right support structure to minimize the obviousness of the connectors when the shoe is worn without the detachable panels. The left support structure has one or more complementary left panel connectors 340-1, 340-2, 340-*n*, as shown in FIG. 8A, configured to removably couple to the one or more corresponding and complementary left panel connectors 240-1, 240-2, 240-*n*, of the detachable left panel 140. For example, FIGS. 10A-10C show a detachable panel 1000 having hook-and-eye and snap connectors 240-3, 242-3** to detachably connect to the left support structure having complementary connectors.

In some embodiments, the detachable right panel 142 configured to detachably connect to the right support structure 132 has one or more right panel connectors 242-1, 242-2, **242-*n* as shown in FIG. 10A. The right support structure 132 has one or more complementary right panel connectors 342-1, 342-2, 342-*n*, as shown in FIGS. 4A-4C, configured to removably couple to the one or more right panel connectors 242-1, 242-2, 242-*n* of the detachable right panel 142. For example, FIGS. 10A-10C show a detachable panel having hook and eye or snap connectors 240-3, 242-3** to detachably connect to the right support structure having complementary connectors.

In some embodiments, the left support structure 130 and the right support structure 132 includes female connectors embedded within the respective support structure. In some embodiments, the left support structure 130 and the right support structure 132 includes male connectors embedded within the respective support structure. In some embodiments, the left support structure 130 and the right support structure 132 includes a combination of male and female connectors embedded within the respective support structure. In some embodiments, the left support structure 130 includes female connectors embedded within the structure and the right support 132 structure includes male connectors embedded within the structure. In some embodiments, the detachable left panel 140 includes male connectors embedded with the left support structure 130, the detachable right panel 142 includes female connectors embedded within the right support structure 132, and both the left and right detachable panels 140, 142, are configured to detachably connect to the left and right support structure 130, 132, respectively.

In some embodiments, the toe box 102, heel portion 106, counter 118, and the detachable left and right panels 140, 142 are of the same material on the outer surface thereof. For example, the toe box 102, heel portion 106, counter 118, and the detachable left and right panels 140, 142 are made of a black leather material on the outer surface.

In some embodiments, the toe box 102, heel portion 106, counter 118, and the detachable left and right panels 140, 142 are made from different materials on the outer surface thereof. For example, the toe box 102, heel portion 106, and counter 118 are made of a black leather material and the detachable left and right panels 140, 142 are made of a black suede material on the outer surface. In some embodiments, the detachable left and right panels 130, 132 are made of different materials.

In some embodiments, the toe box 102, heel portion 106, counter 118, and the detachable left and right panels 140, 142 have the same pattern on the outer surface thereof. For example, the toe box 102, heel portion 106, counter 118, and the detachable left and right panels 140, 142 all have a hounds-tooth pattern on the surface of the footwear.

In some embodiments the toe box 102, heel portion 106, counter 118, and the detachable left and right panels 130, 132 have different patterns on the outer surface thereof. For example, the toe box 102, heel portion 106, counter 118 may have a solid print pattern, and the detachable left and right panels 130, 132 have a floral or animal print pattern on the surface. In some embodiments, the detachable left and right panels 130, 132 have different patterns or graphics.

Figure 7A:
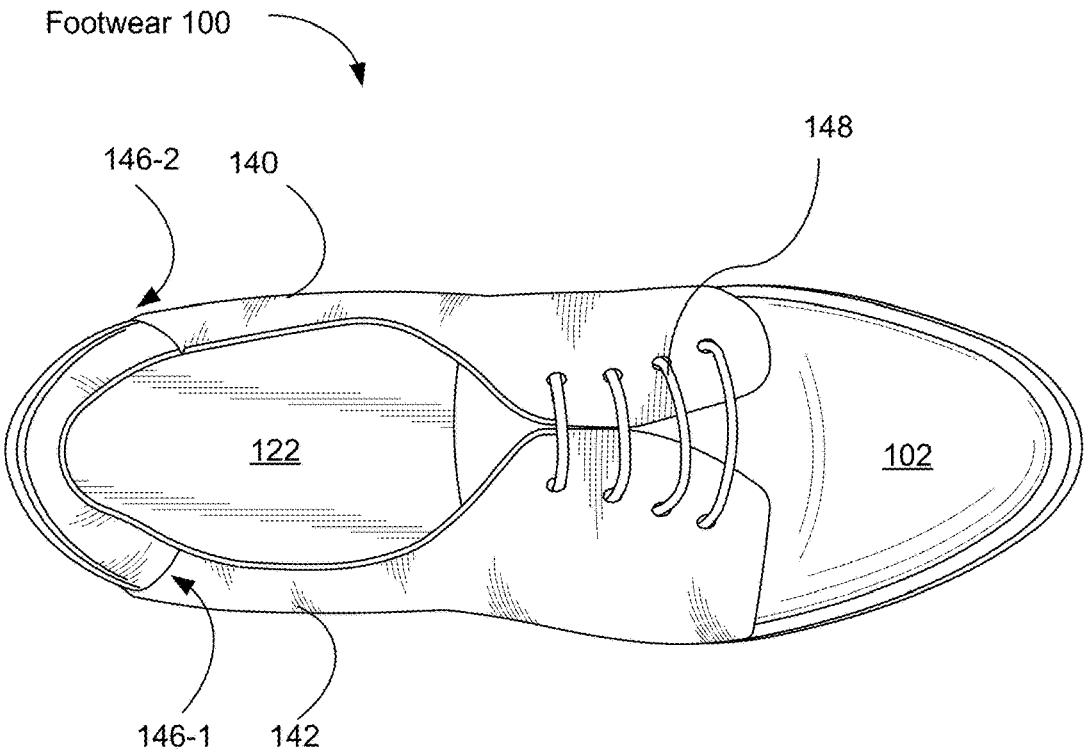
Figure 7B:
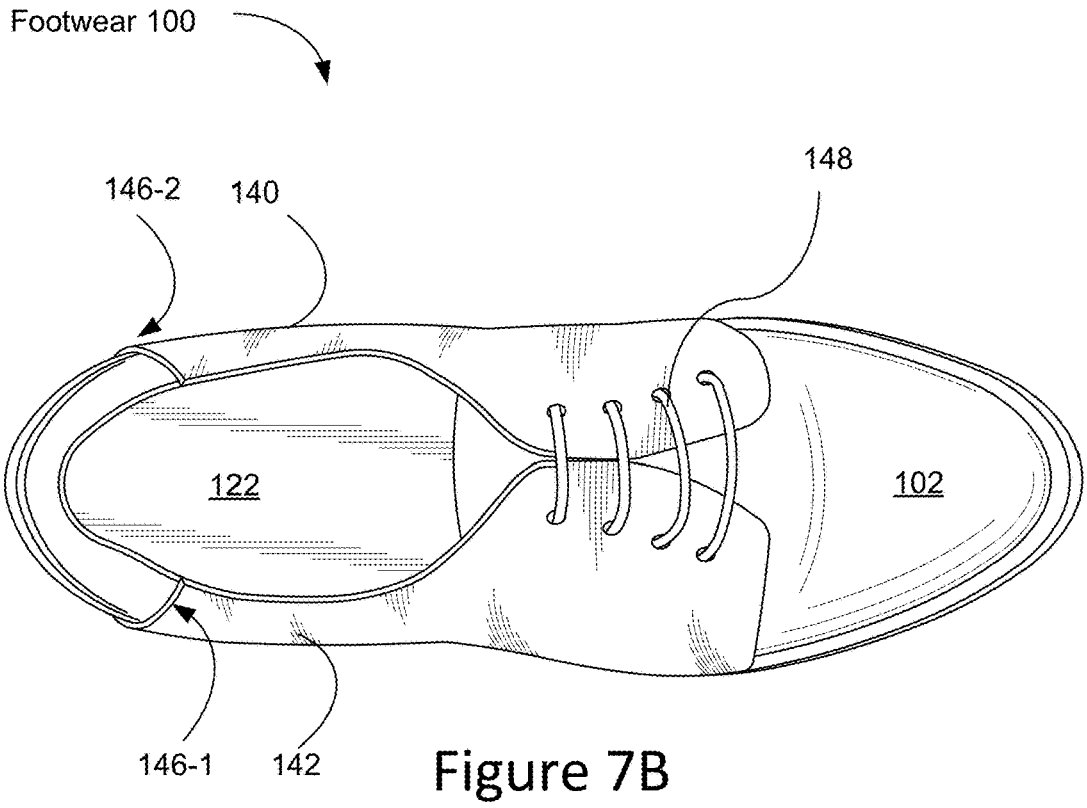
Figure 7C:
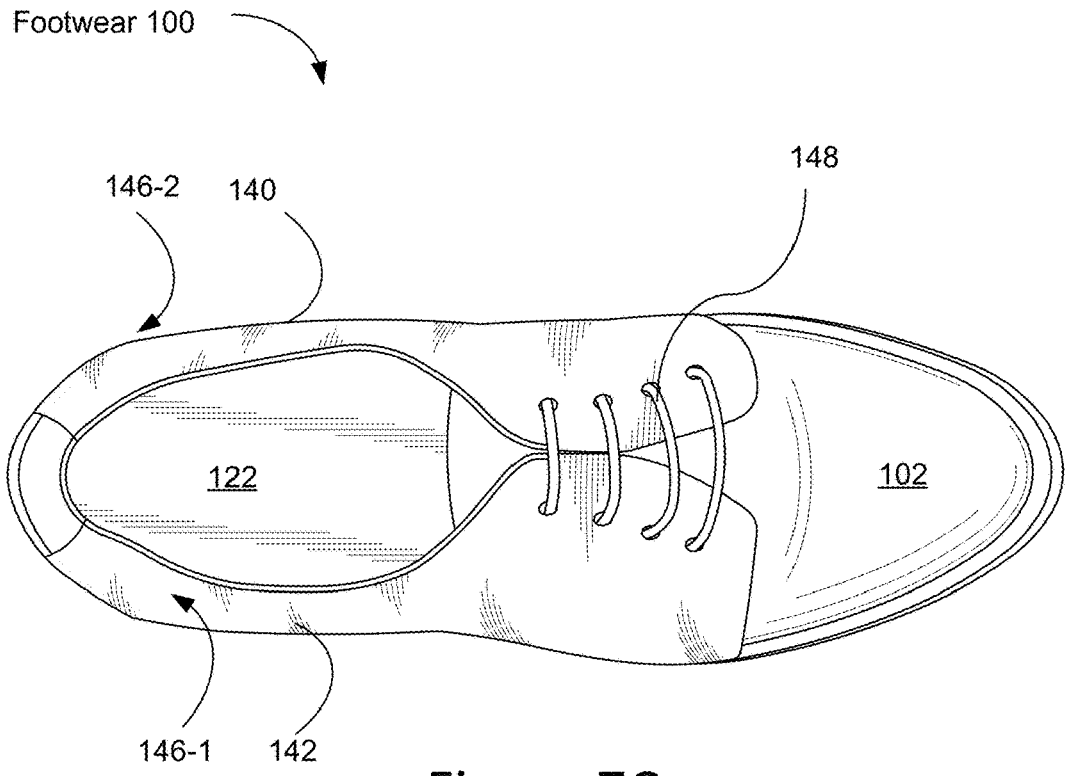

In some embodiments, as shown in FIG. 7C, the detachable left and right panels 130, 132 are longer to cover a substantially larger portion of the counter 118.

Figure 7D:
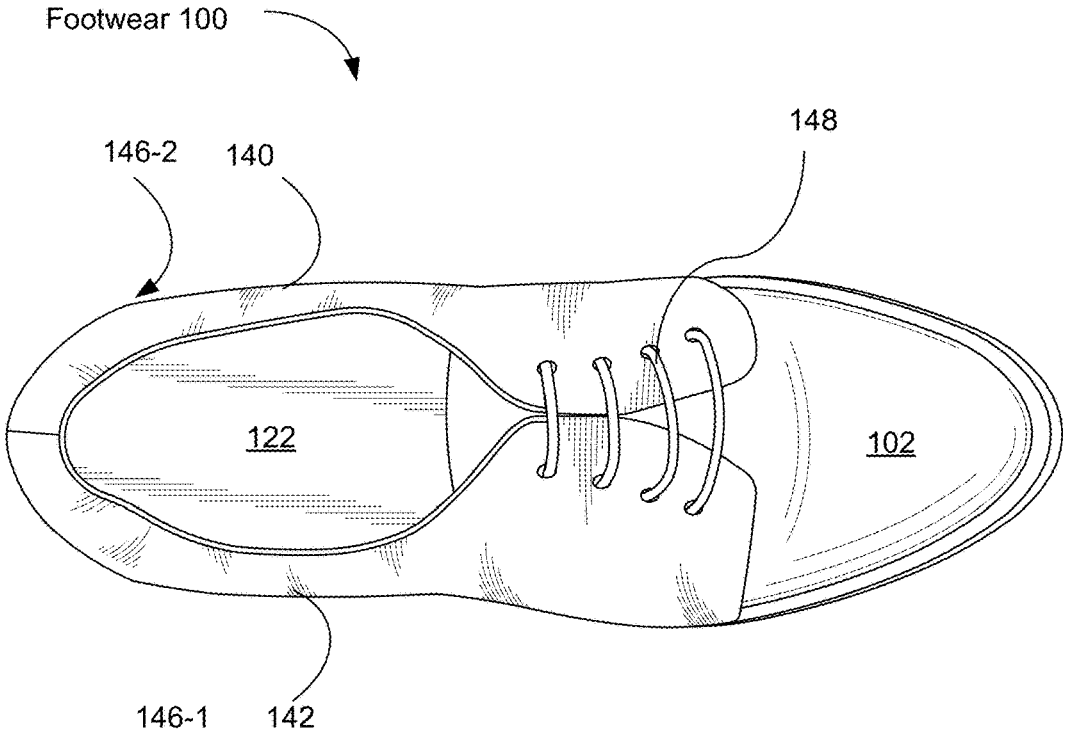

In some embodiments, as shown in FIG. 7D, the detachable left and right panels 130, 132 are configured to cover the counter 118 and attach to each other at the heel portion 106. In some embodiments, the detachable left and right panels 130, 132 are configured to detachably connect to each other at the heel portion 106 using any suitable connection mechanism.

Figure 9:
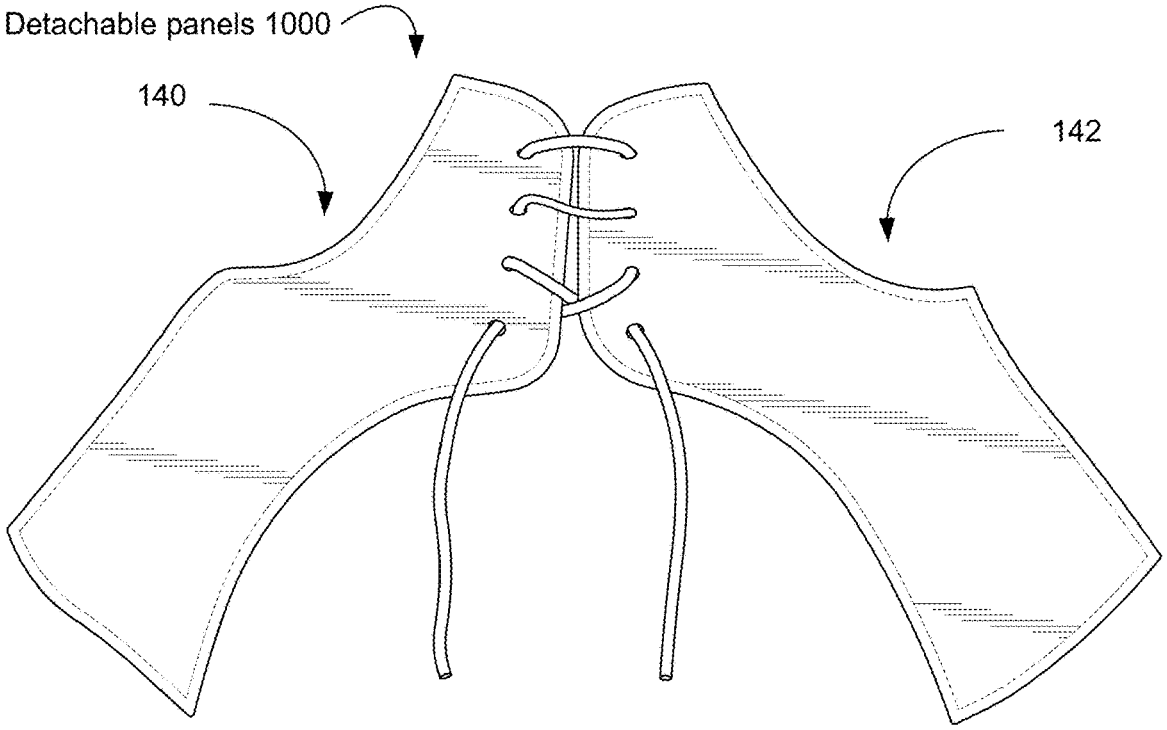
FIGS. 9, 10A-10C illustrate exemplary detachable footwear panels in accordance with some embodiments.

FIGS. 9-10C illustrate exemplary detachable panels used in the footwear in FIGS. 5-8D in accordance with some embodiments. The detachable footwear panels 1000 generally comprises a first detachable panel 1100 (e.g., left detachable panel 140) configured to cover a left support structure of a wearer's footwear 100. The detachable footwear panels 1000 additionally comprises a second detachable panel (e.g., right detachable panel 142) configured to cover a right support structure of the wearer's footwear 100. In some embodiments, a shoelace or zipper (not shown) couples the first and second detachable panel together.

In some embodiments, the first and second detachable panels have a plurality of eyelet holes to weave a shoelace there through. In some embodiments, the shoelace is woven through the plurality of eyelet holes to connect the first detachable panel and the second detachable panel together.

In some embodiments, the first and second detachable panels have opposite and complementary zipper teeth to zip the discrete panels together. In some embodiments the first and second detachable panels couple together using a hook and eye, hook and loop, and snap connector means.

In some embodiments, the first and second detachable panels are substantially mirror images of each other in shape and size.

In some embodiments, the first and second detachable panels include an inner surface thereof having one or more connection mechanisms In some embodiments, the first detachable panel includes male connectors embedded within or attached to the panel, the second detachable panel includes female connectors embedded within or attached to the panel, and both the first and second detachable panels are configured to detachably connect to the left and right support structure, respectively.

Figure 11:
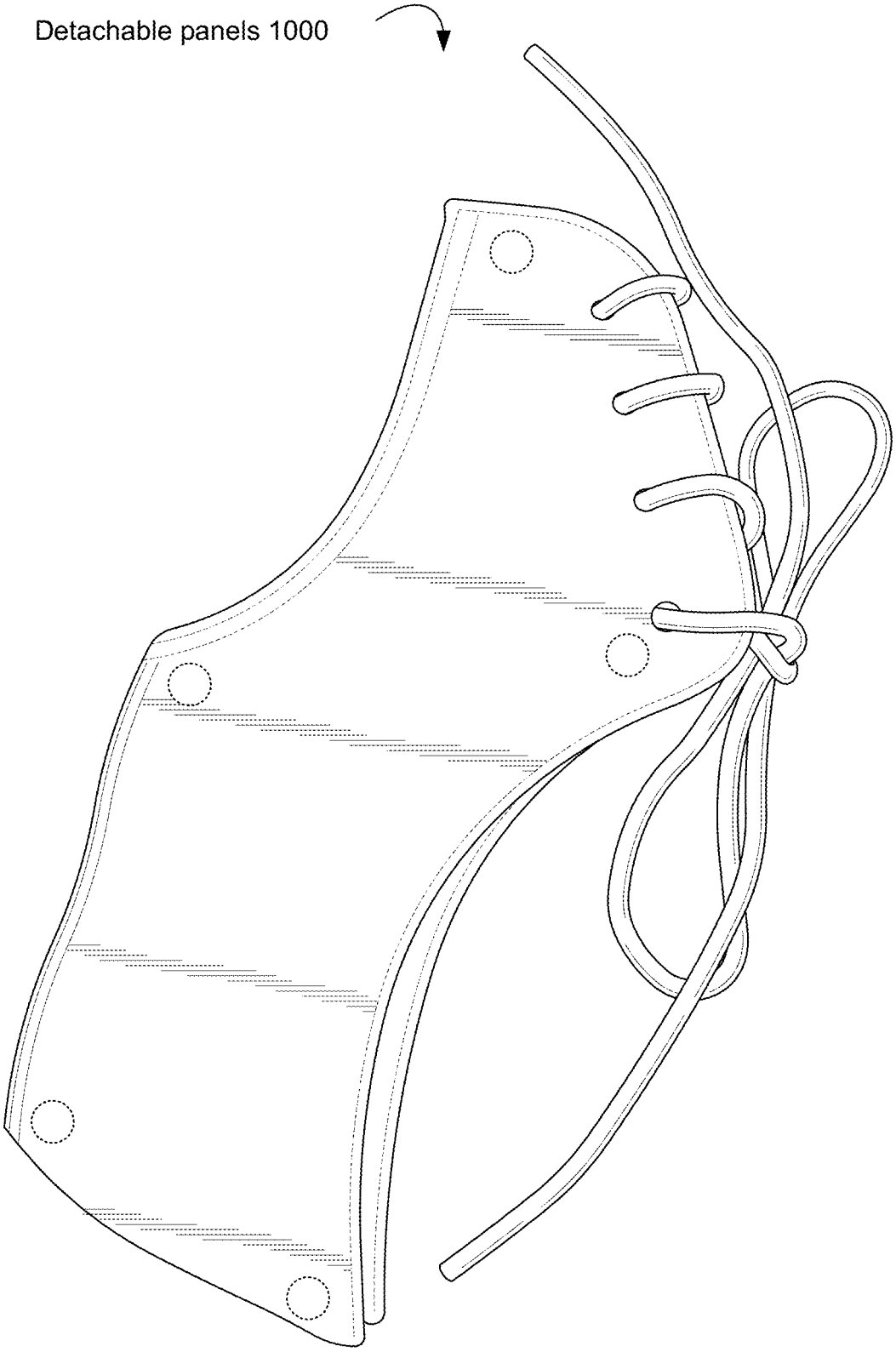
FIG. 11 illustrates exemplary detachable footwear panels in accordance with some embodiments.
Figure 12A:
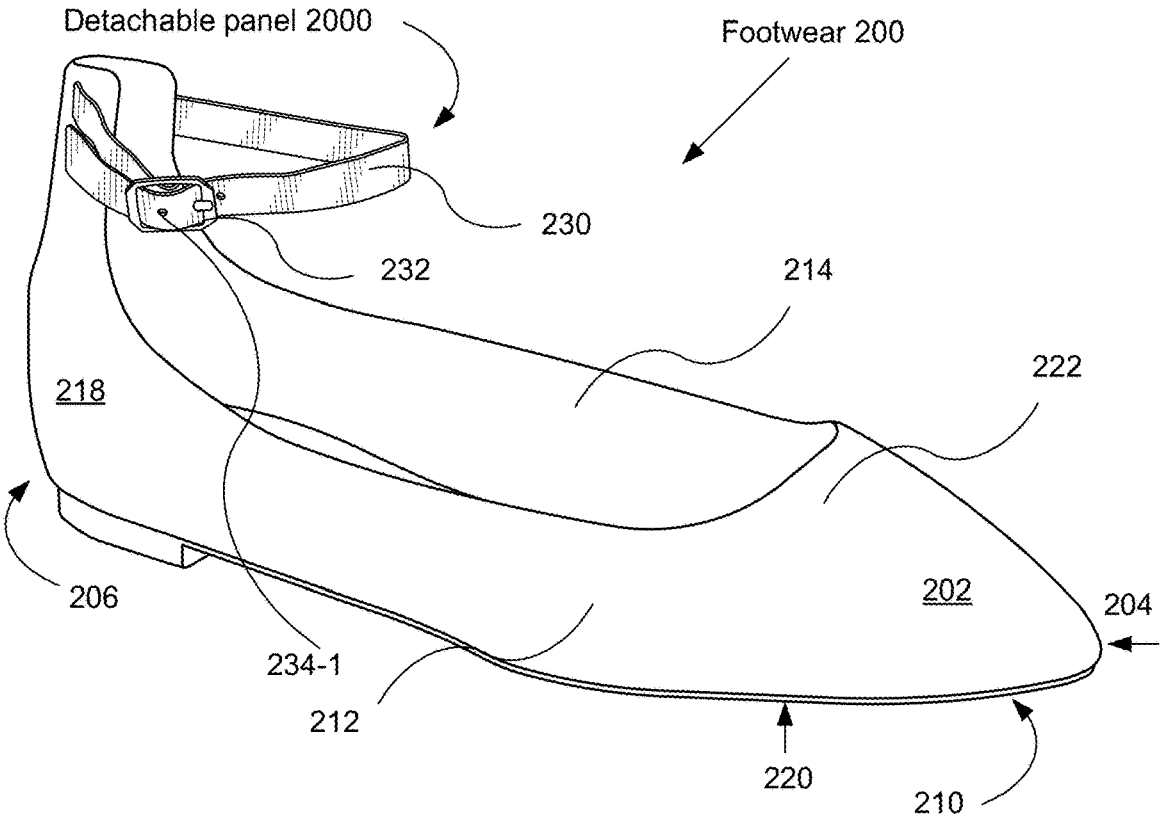
FIGS. 12A-12D illustrate exemplary detachable footwear panels attached to a different shoe style in accordance with some embodiments.
Figure 12B:
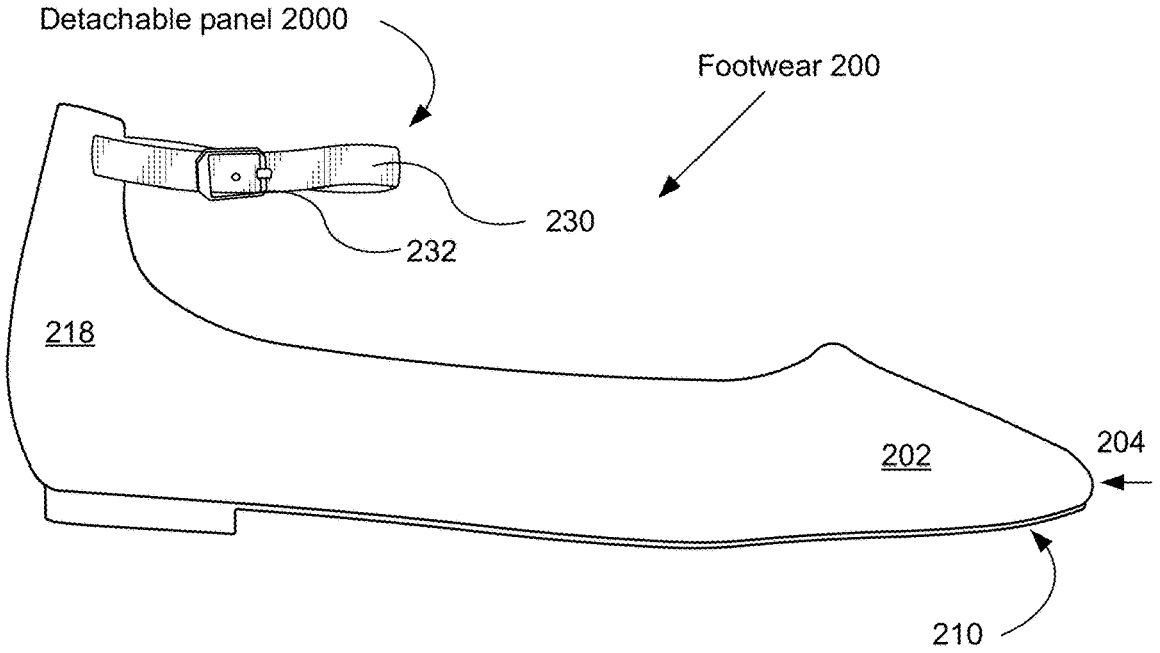
Figure 12C:
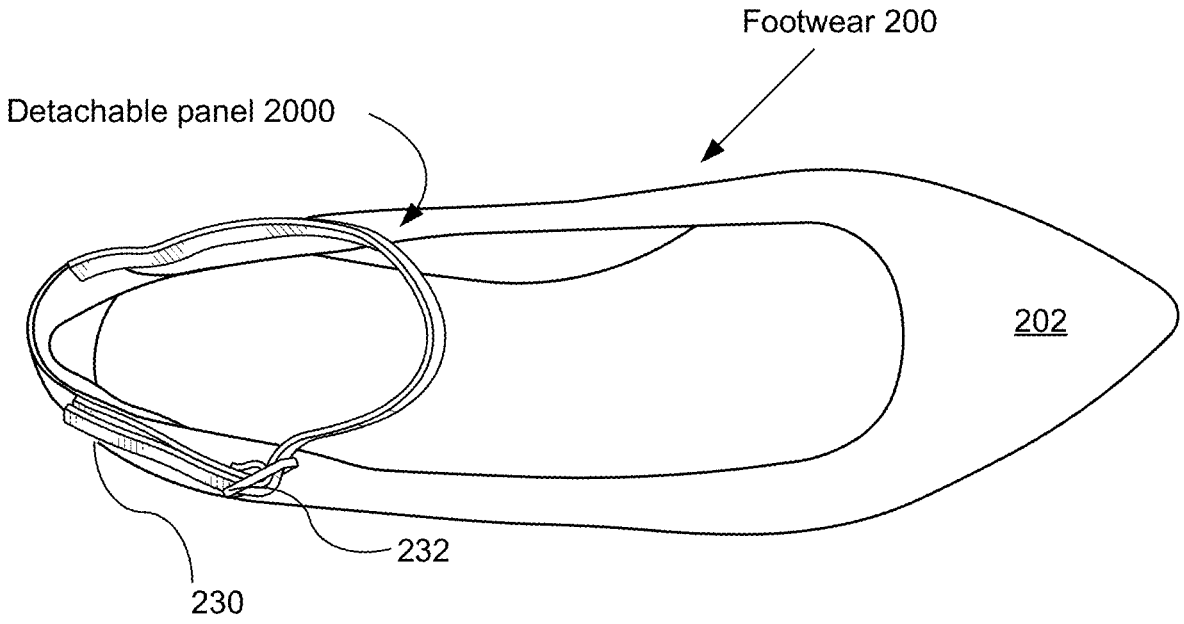
Figure 12D:
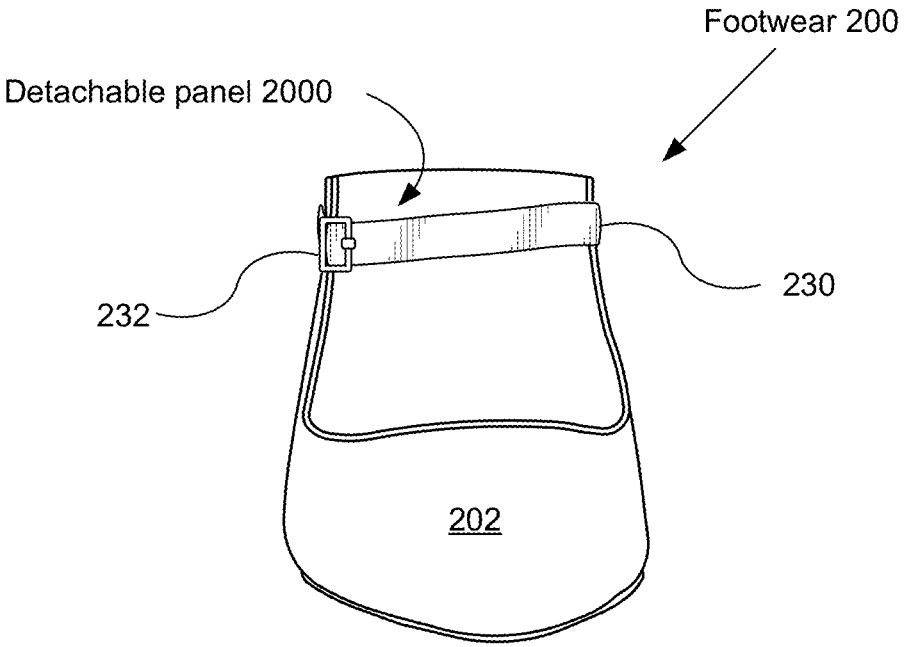
Figure 13A:
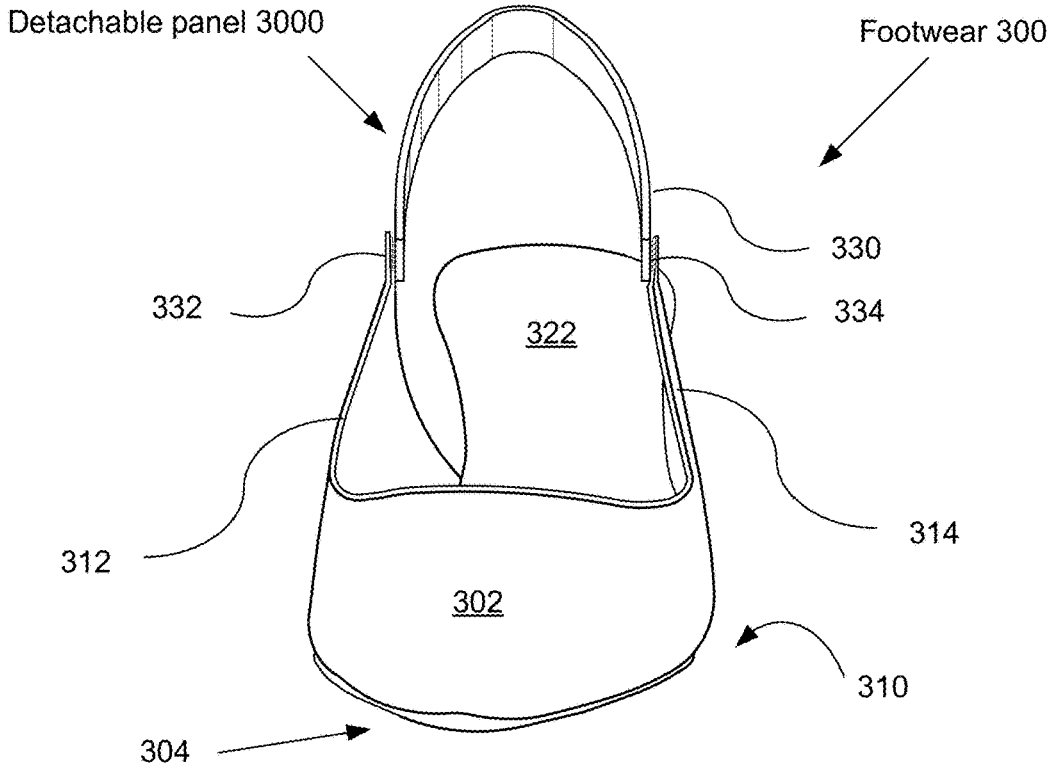
FIGS. 13A-13D illustrate exemplary detachable footwear panels attached to another different shoe style in accordance with some embodiments.
Figure 13B:
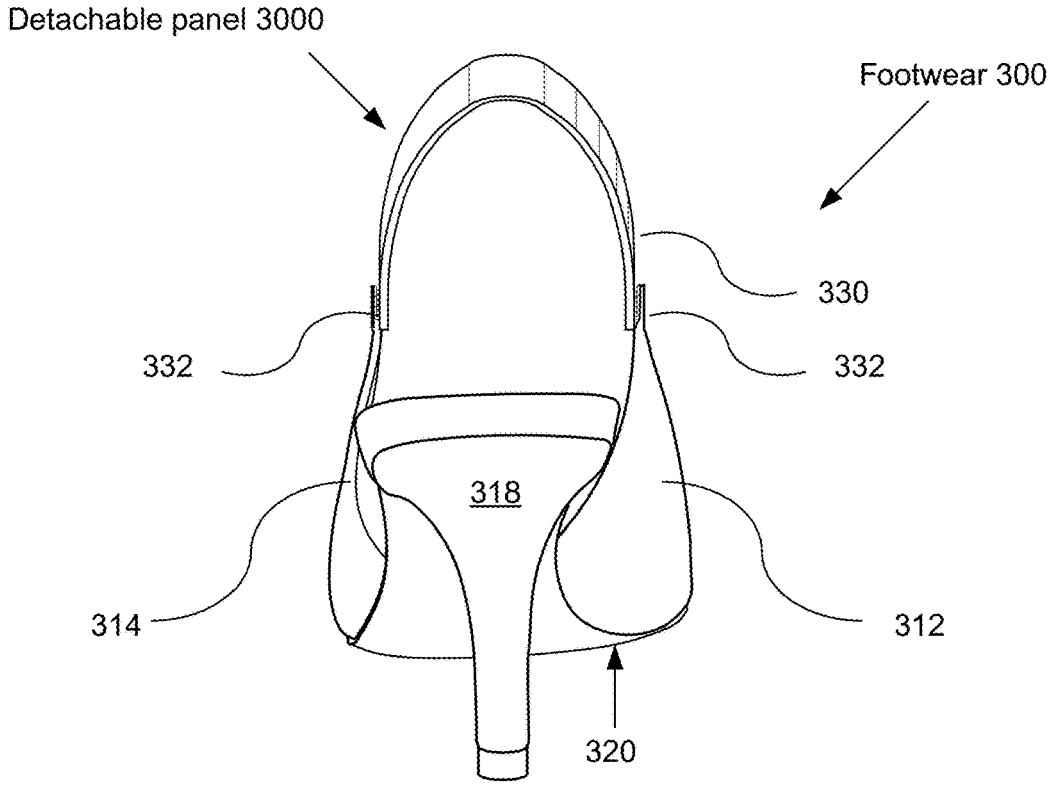
Figure 13C:
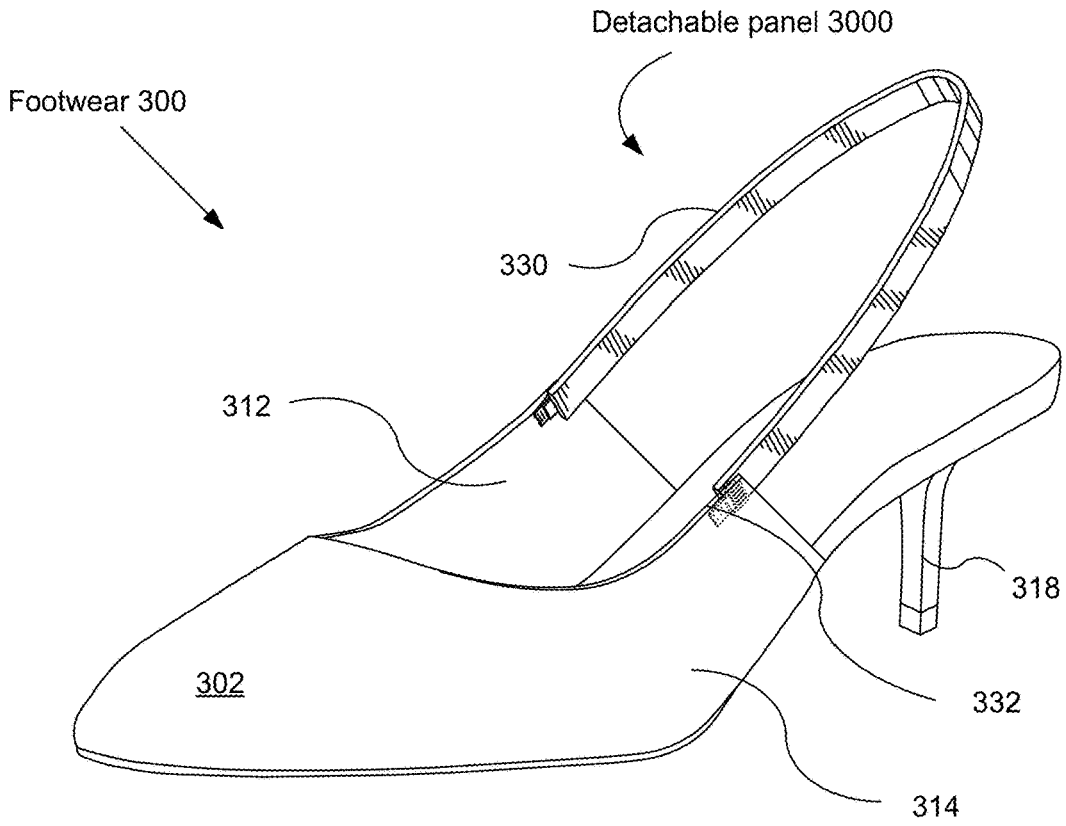
Figure 13D:
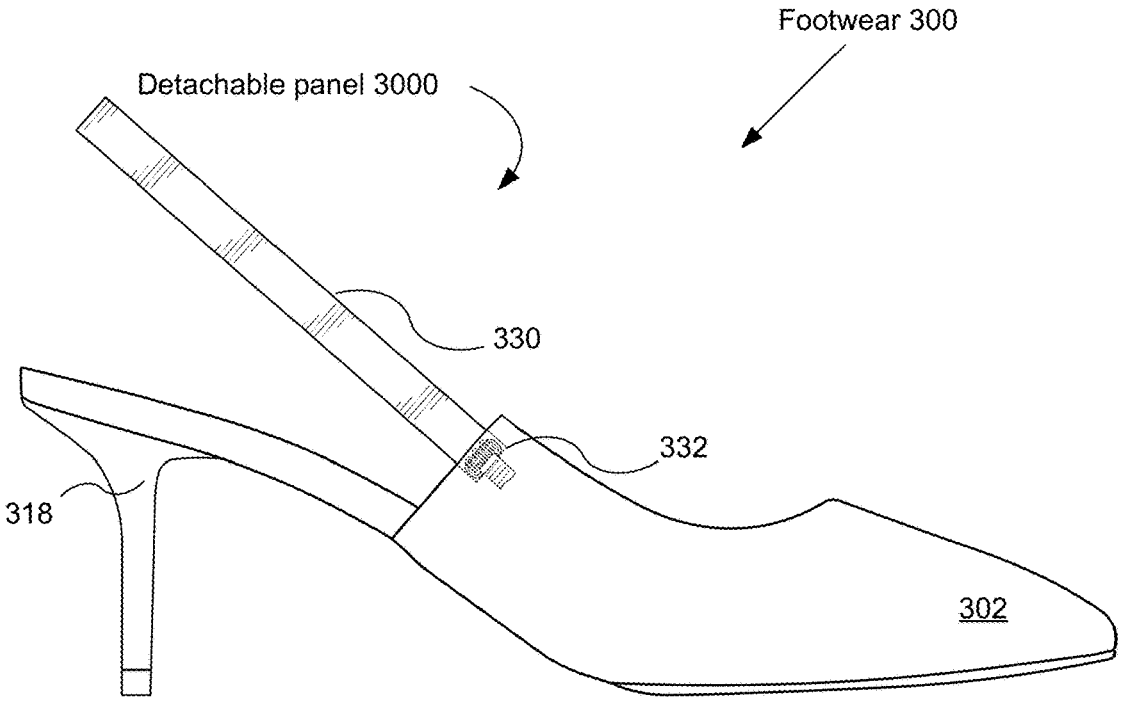

In some embodiments, the first and the second detachable panel is configured to connect to each other using the connectors embedded within or attached to the inner surfaces of the respective panels. For example, as shown in FIG. 11, the first and second detachable panel can be folded together at the laces and connected to each other using the connectors embedded within or attached to the inner surfaces of the respective panels. The detachable panels 1000 may be snapped, hooked, zipped or attached together using any suitable means.

FIGS. 12A-12D illustrate exemplary detachable footwear in accordance with some embodiments. The detachable footwear panels 2000 may have a different size, style, and/or shape, depending on the style of the footwear. FIGS. 12A-12D illustrate the footwear 200, which includes the base 210 having a toe portion 204, the heel portion 206, the base left side 214, the base right side 212, the base bottom surface 220, the base top surface 222, the toe box 202, the counter 218, and the detachable panel 2000 in accordance with some embodiments.

In some embodiments, the detachable footwear panel 2000 is configured to surround the wearer's ankle. In some embodiments the detachable footwear panel 2000 may have the same properties as the detachable footwear panels 1000.

In some embodiments, the detachable footwear panel 2000 comprises a strap 230 having a buckle 232 and a plurality of holes 234-1, 234-2, **234-*n*. For example, FIG. 12**A shows a footwear having a singular detachable panel having a strap, buckle, and a plurality of holes to adjust the latching of the buckle around a wearer's ankle.

In some embodiments (not shown), the detachable footwear panel 2000 has hook-and-eye connectors, snap connectors, hook-and-loop connectors, or any other suitable connection mechanism to detachably couple the detachable footwear panel 2000 to the footwear and to another panel as discussed above.

In some embodiments, the toe box 202, heel portion 206, counter 218, and the detachable footwear panel 2000 have the same material on the outer surface thereof.

In some embodiments, the toe box 202, heel portion 206, counter 218, and the detachable footwear panel 2000 have different materials on the outer surface thereof.

In some embodiments, the toe box 202, heel portion 206, counter 218, and the detachable footwear panel 2000 have the same pattern on the outer surface thereof.

In some embodiments, the toe box 202, heel portion 206, counter 218, and the detachable footwear panel 2000 have different patterns on the outer surface thereof.

FIGS. 13A-13D illustrate exemplary detachable footwear panels used with a different style of footwear in accordance with some embodiments. The detachable footwear panel 3000 has a different size, style, and/or shape, depending on the style of the footwear. FIGS. 13A-13D illustrate the footwear 300 that includes base 310 having a toe portion 304, the heel 318, the base left side 314, the base right side 312, the base bottom surface 320, the base top surface 322, the toe box 302, and detachable panel 3000 in accordance with some embodiments.

In some embodiments, the detachable footwear panel 3000 is configured to detachably connect to the left support structure 334 and the right support structure 332 of the base left side 314 and the base right side 312, respectively.

In some embodiments, the detachable footwear panel 3000 is configured to surround the wearer's ankle/heel area for footwear 300. In some embodiments the detachable footwear panel 3000 may have the same properties as the detachable footwear panels 1000 and/or 2000.

In some embodiments (not shown), the detachable footwear panel 3000 comprises a strap having a buckle and a plurality of holes as described above in regards to FIGS. 12A-12D.

In some embodiments (not shown), the detachable footwear panel 3000 has hook-and-eye connectors, snap connectors, hook-and-loop connectors, or any other suitable connection mechanism to detachably couple the singular detachable panel 3000 to the footwear and to another panel as described above in regards to FIGS. 12A-12D.

In some embodiments, the toe box 302, heel 318, and the detachable footwear panel 3000 are of the same material on the outer surface thereof.

In some embodiments, the toe box 302, heel 318, and the detachable footwear panel 3000 are made from different materials on the outer surface thereof. For example, the detachable footwear panel 3000 is made of an elastic material whereas the footwear 300 is made of a patent leather material.

In some embodiments, the toe box 302, heel 318, and the detachable footwear panel 3000 have the same pattern on the outer surface thereof.

In some embodiments, the toe box 302, heel 318, and the detachable footwear panel 3000 have different patterns on the outer surface thereof.

Figure 14A:
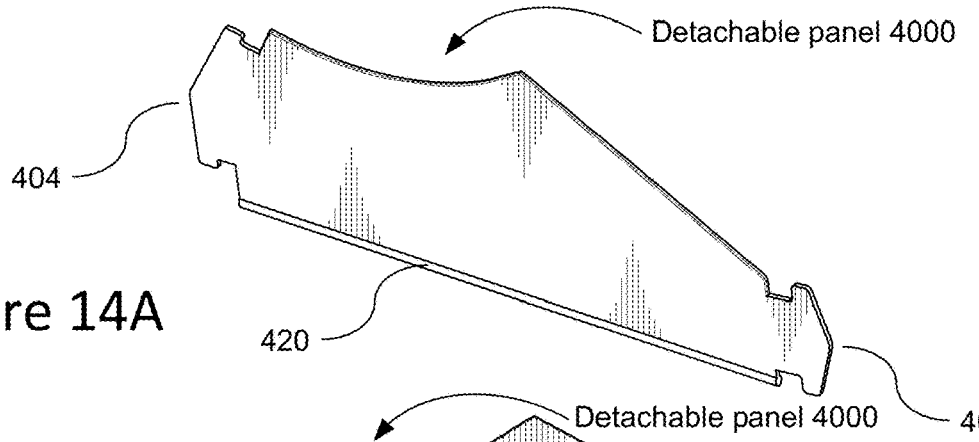
FIGS. 14A-14G illustrate exemplary detachable footwear panels in accordance with some embodiments.
Figure 14B:
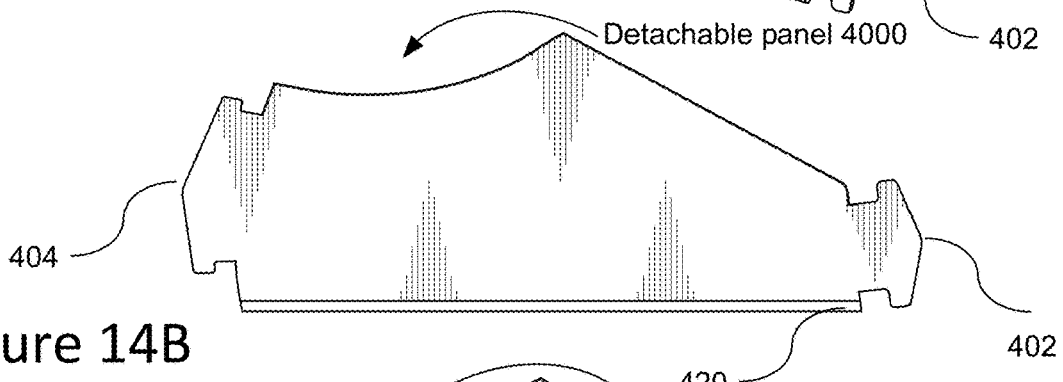
Figure 14C:
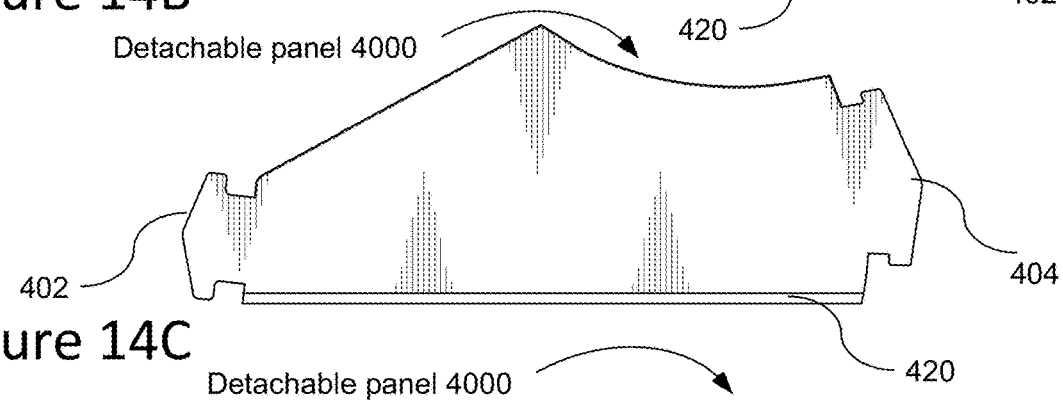
Figure 14D:
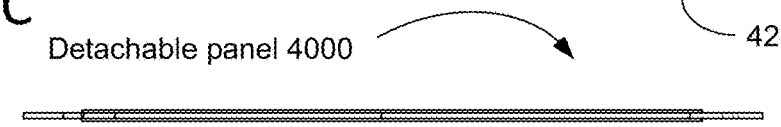
Figure 14E:
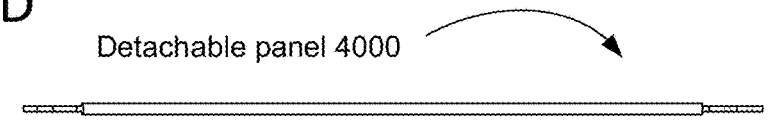
Figures 14F, 14G:
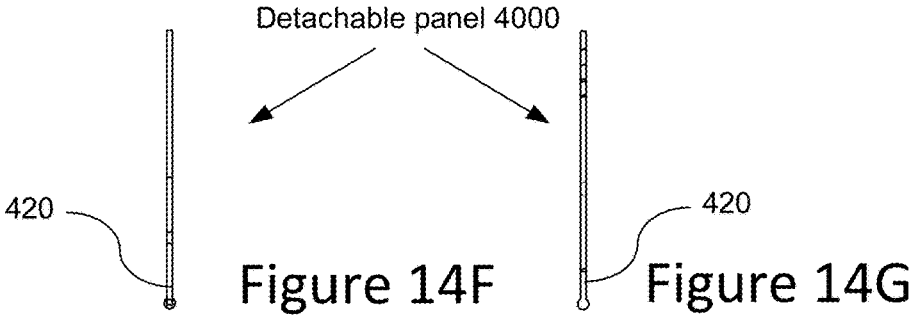

FIGS. 14A-14G illustrate exemplary detachable panels in accordance with some embodiments. For example, FIGS. 14A-14C shows a single detachable panel 4000 having a first 402 and second 404 elongated end to tuck into slots at the toe box (not shown) and counter (e.g., slot 146-1) as seen in FIGS. 2-4A. FIGS. 14A-14C illustrate a male slider 420 for attaching the detachable panel 4000 to footwear 100. For example, the slider 420 is configured or keyed to slide into a corresponding channel on the footwear 100, such that the detachable panel 4000 is secured to the footwear 100. FIGS. 14D-14G illustrate detachable footwear panels 400 in various orientations. FIGS. 14A-14G show an exemplary detachable panel for the right side of footwear 100. It is appreciated that a substantially similar, mirror image panel exists for the left side of the footwear. Additionally, it is appreciated that a separate set of detachable panels exists for the wearer's left footwear.

Figure 15A:
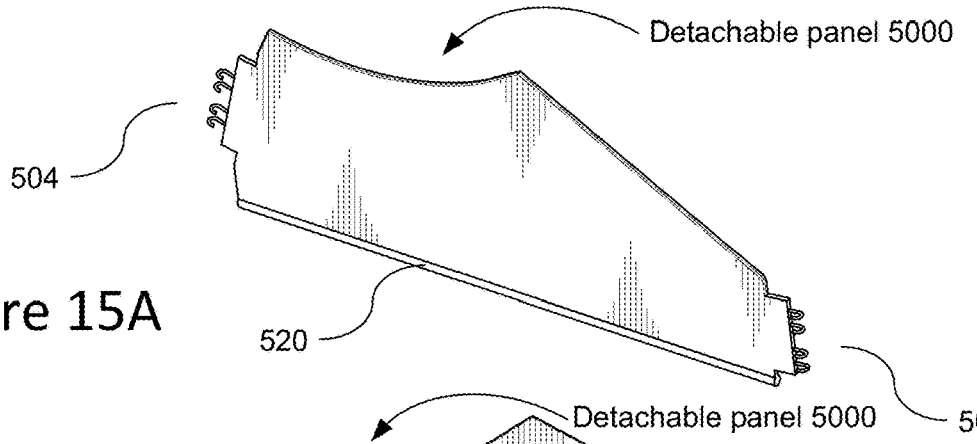
FIGS. 15A-15G illustrate exemplary detachable footwear panels in accordance with some embodiments.
Figure 15B:
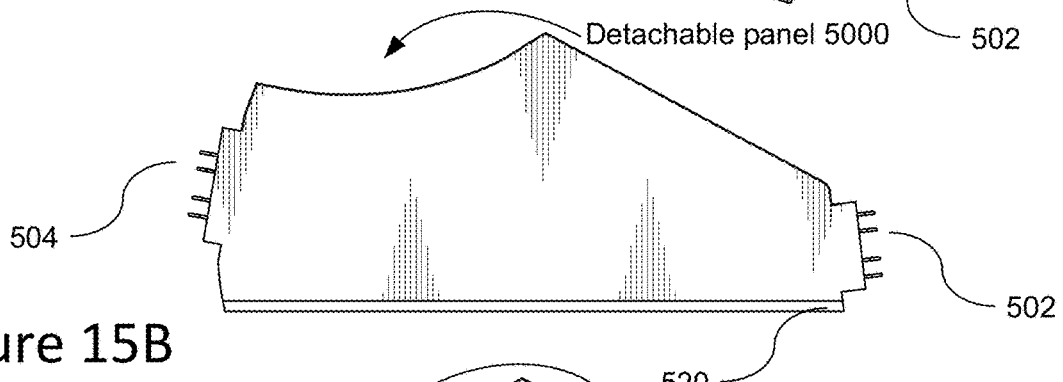
Figure 15C:
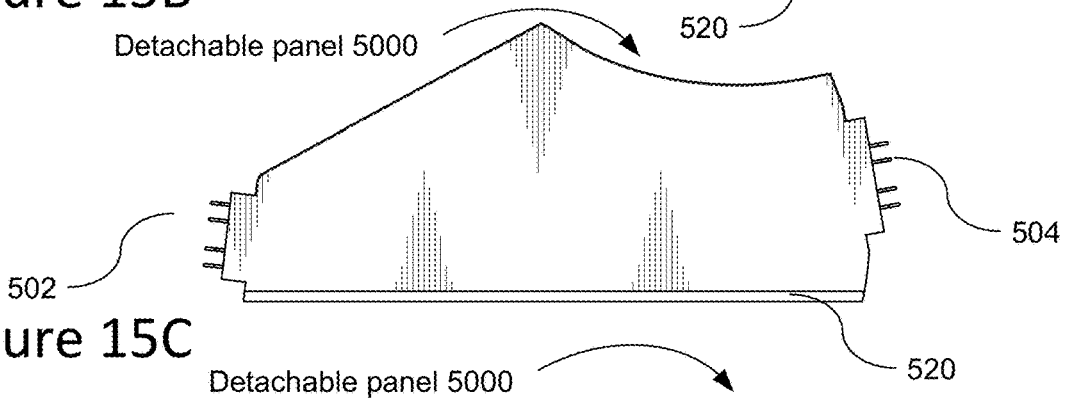
Figure 15D:
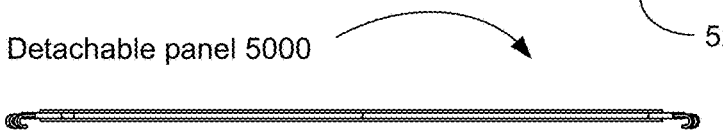
Figure 15E:
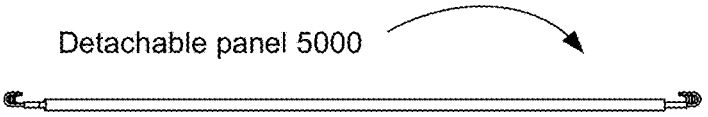
Figures 15F, 15G:
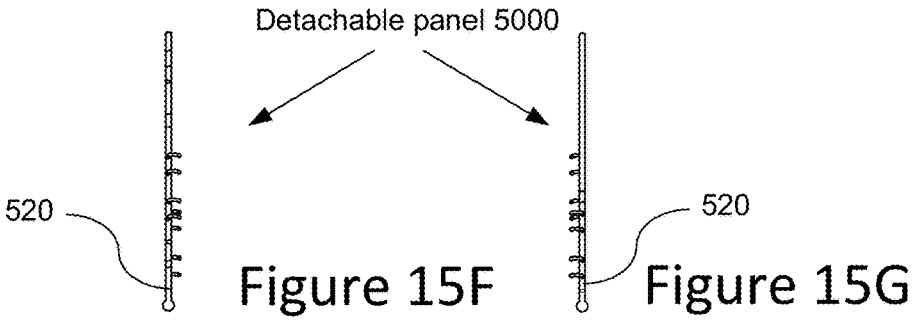

FIGS. 15A-15G illustrate exemplary detachable panels in accordance with some embodiments. For example, FIGS. 15A-15C shows a single detachable panel 5000 having a first 402 and second 404 end to hook into slots at the toe box (not shown) and counter (e.g., slot 146-1) as seen in FIGS. 2-4A. FIGS. 15A-15C illustrate a male slider 520 for attaching the detachable panel 5000 to footwear 100. For example, the slider 520 is configured or keyed to slide into a corresponding channel on the footwear 100, such that the detachable panel 5000 is secured to the footwear 100. FIGS. 15D-15G illustrate detachable footwear panels 400 in various orientations. FIGS. 15A-15G show an exemplary detachable panel for the right side of footwear 100. It should be appreciated to a person having ordinary skill in the art that a substantially similar, mirror image panel exists for the left side of the footwear or shoe. Additionally, it is appreciated that a separate set of detachable panels exists for the wearer's left footwear.

Figure 16A:
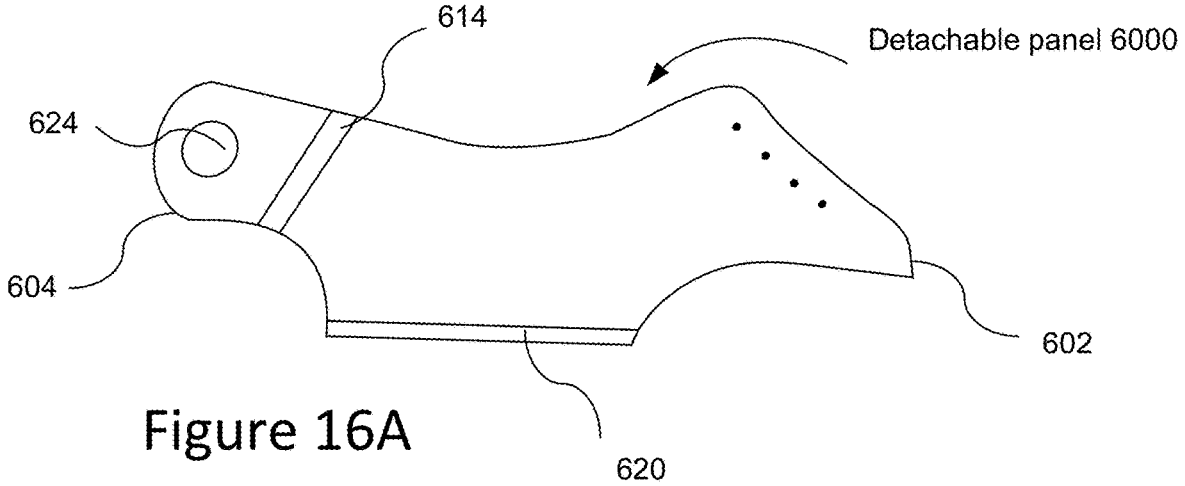
FIGS. 16A-16B illustrate exemplary detachable footwear panels in accordance with some embodiments.
Figure 16B:
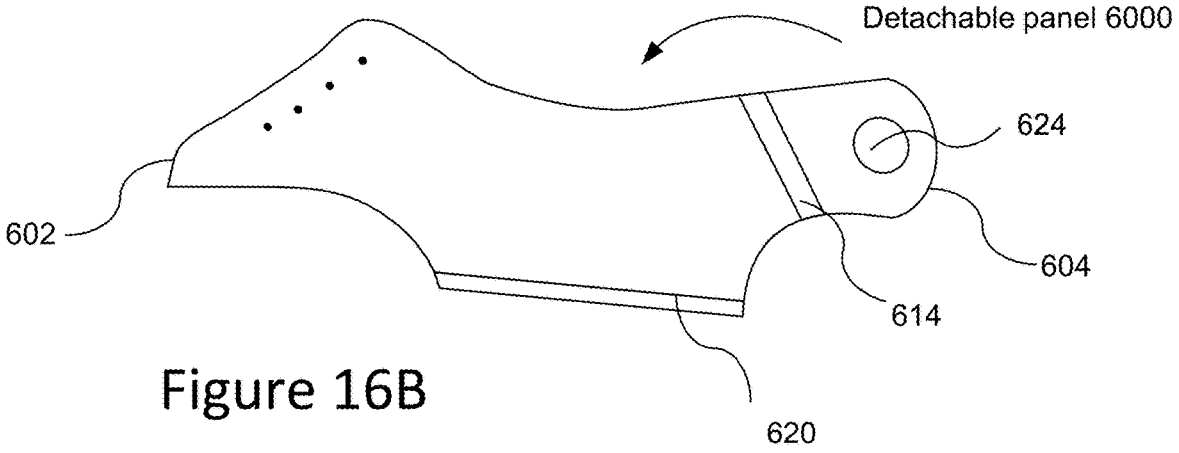

FIGS. 16A-16B illustrate exemplary detachable panels in accordance with some embodiments. For example, FIGS. 16A-16B show a single detachable panel 6000 having a first end 602 and second end 604. The second end 604 includes an opening 624 used to attach to the footwear at the counter 118. The second end 604 also includes an elastic portion 614 that allows the panel to flex or stretch when being secured at the counter 118. Detachable panel 6000 includes a slider 620 that is configured or keyed to slide into a corresponding channel on the footwear 100, such that the detachable panel 6000 is secured to the footwear 100. When coupling the panel to the footwear, the slider 620 is slid into a keyed channel on the footwear and pulled backward until the slider reaches the end of the channel. The second end is then pulled backward, causing the elastic portion 614 to stretch and the opening 624 is secured to the counter of the footwear to secure the panel in place.

Figure 17A:
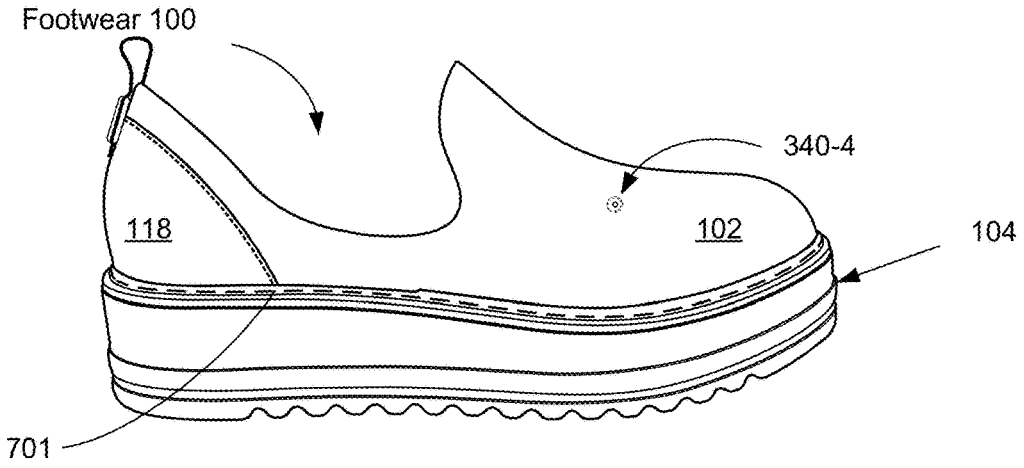
FIGS. 17A-17C illustrate the exemplary right shoe of FIGS. 16A-16B but here with the detachable panels attached to the shoe in accordance with some embodiments.
Figure 17B:
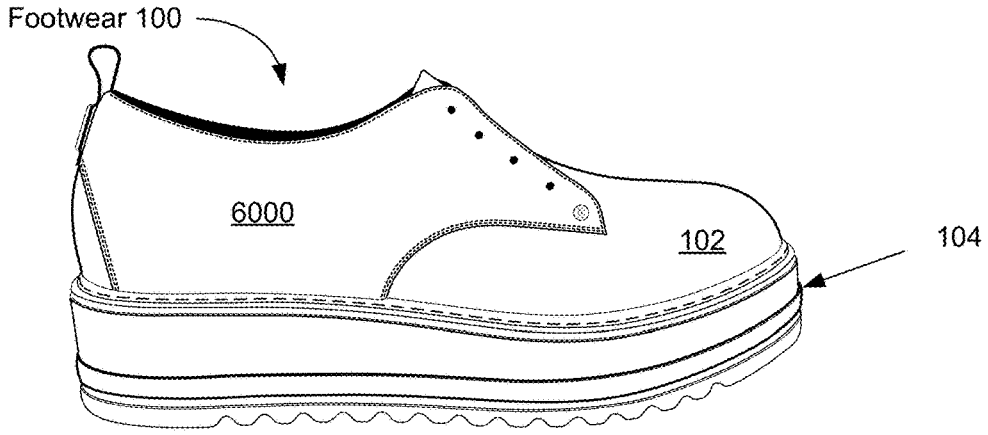
Figure 17C:
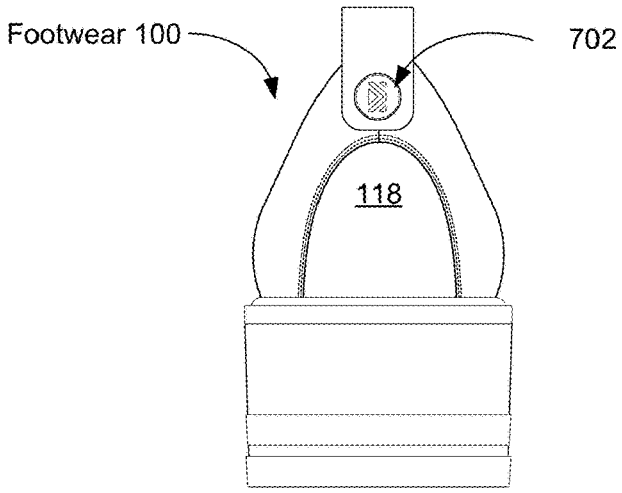

FIGS. 17A-17C illustrate an exemplary right shoe to which the panels 6000 of FIGS. 16A-16B connect. FIG. 17A shows the footwear 1000 without the detachable panel 6000. The footwear 1000 includes a connector 340-4 close to the toe box 102. FIG. 17B shows a side view of footwear 100 with the detachable panel 6000 attached. FIG. 17C shows a rear view of footwear 100 with the detachable panel 6000 attached. Connector 702 attaches the detachable panel 6000 at opening 624, by unclipping a female portion of the connector from a male portion of the connector coupled to the back of the footwear, sliding the sliders 620 of the panels into the channels 701 in the footwear, placing the openings 624 from each panel over the male portion of the connector, and then closing or snapping the female portion to the male portion of the connector to secure the panels at the back of the footwear as shown in FIG. 17B.

Figure 18A:
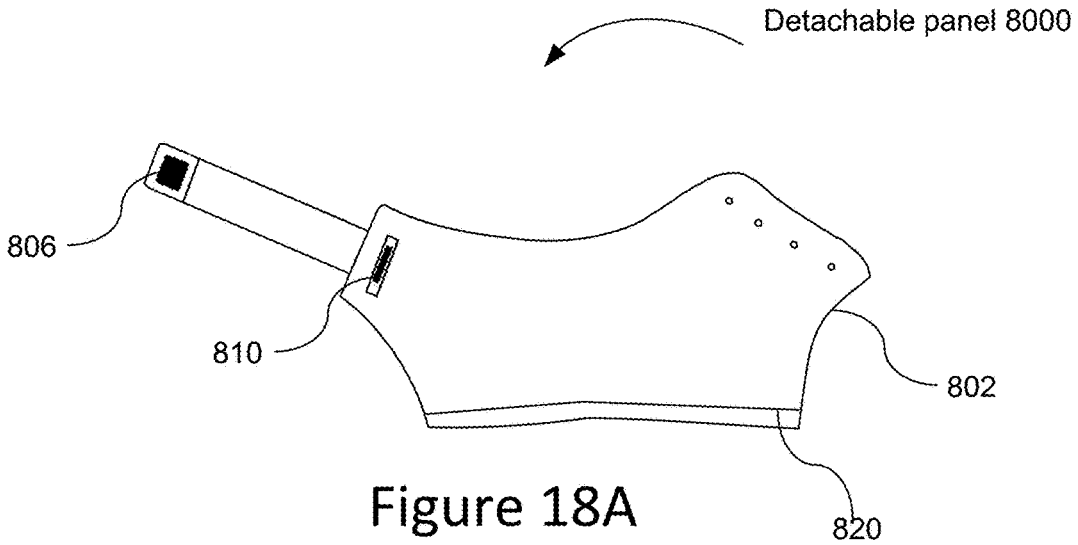
FIGS. 18A-18B illustrate exemplary detachable footwear panels in accordance with some embodiments.
Figure 18B:
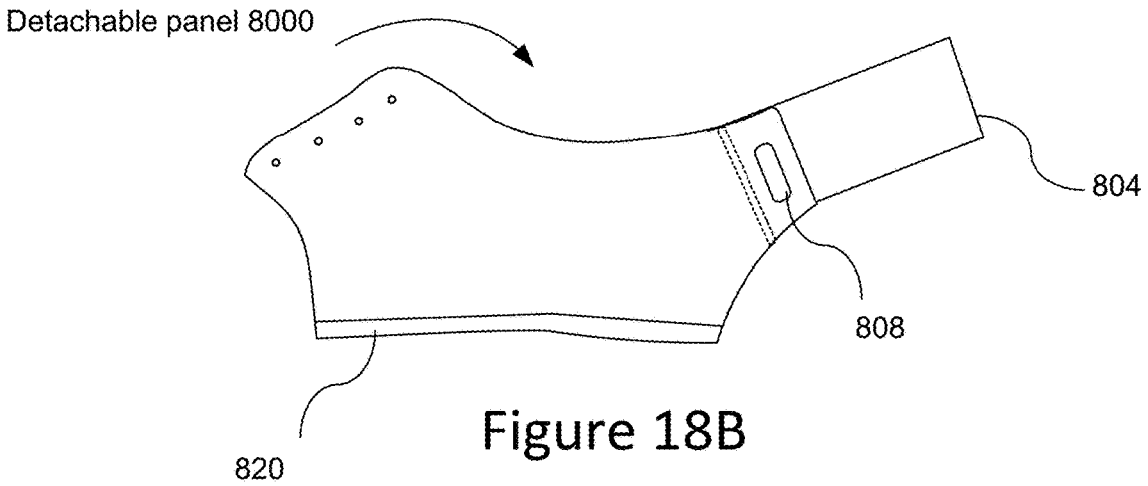

FIGS. 18A-18B illustrate exemplary detachable panels in accordance with other embodiments. For example, FIGS. 18A-18B show a single detachable panel 8000 having a first end 802 and second end 804. The second end 804 of a first panel (e.g., a right-hand panel) includes a connector 806. Connector 806 is configured to slide through an opening 808 of a second panel (e.g., a left-hand panel) and connect at a clasp or receiver 810 of the first panel. Detachable panel 8000 includes also include a slider 820 to detachably connect to footwear 100, in a similar manner to that described above with respect to FIGS. 17A-C.

Figure 19A:
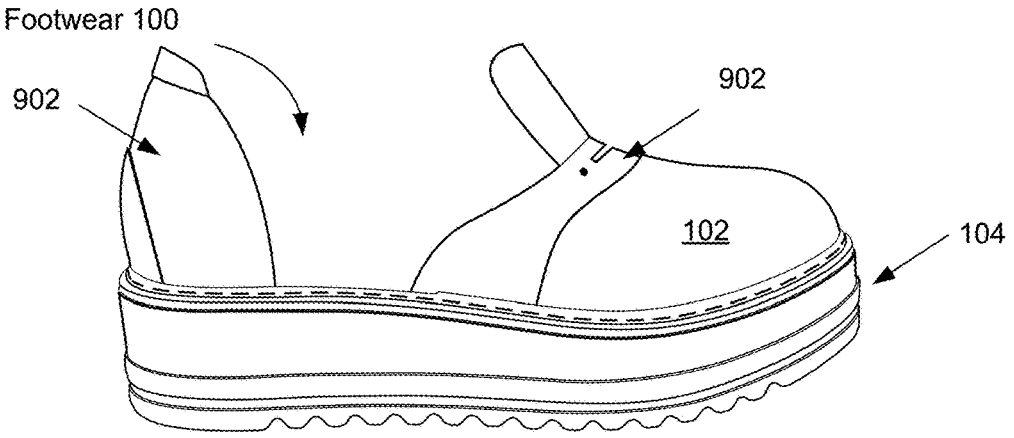
FIGS. 19A-19C illustrate the exemplary right shoe of FIGS. 18A-18B but here with the detachable panels attached to the shoe in accordance with some embodiments.
Figure 19B:
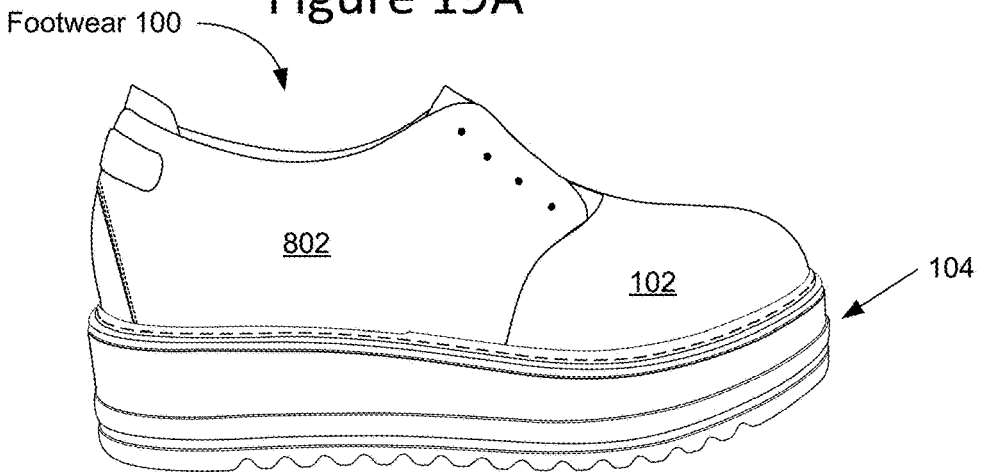
Figure 19C:
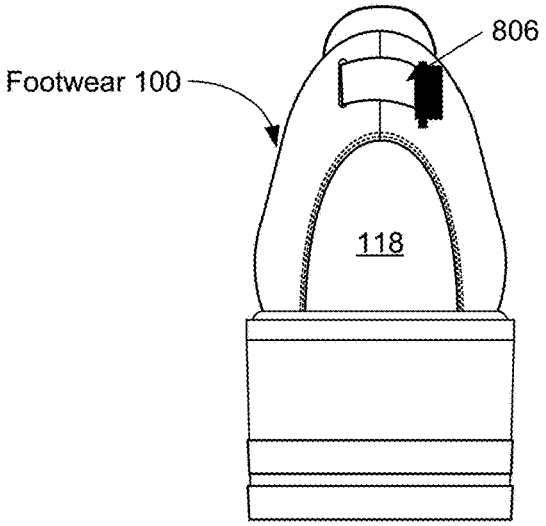

FIGS. 19A-19C illustrate an exemplary right shoe to which the panels 8000 of FIGS. 18A-18B connect. FIG. 19A shows footwear 100 without the detachable panel 8000. Footwear 100 includes indents 902 to allow the detachable panel 8000 to sit flush against the footwear when the detachable panel is attached. FIG. 19B shows a side view of footwear 100 with detachable panel 8000 attached. FIG. 19C shows a rear view of footwear 100 with the detachable panel 8000 attached. Connector 806 is shown at the counter 118 attached to the clasp or receiver 810 (not visible).

Figure 20A:
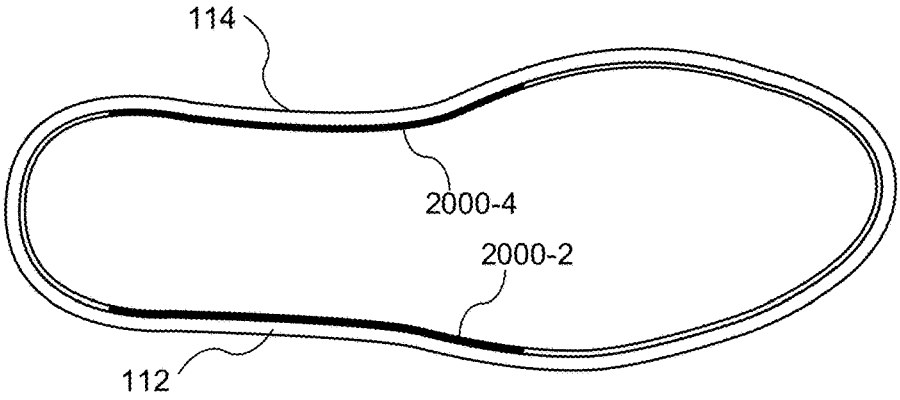
FIGS. 20A-20C illustrate the exemplary right shoe in accordance with some embodiments.
Figure 20B:
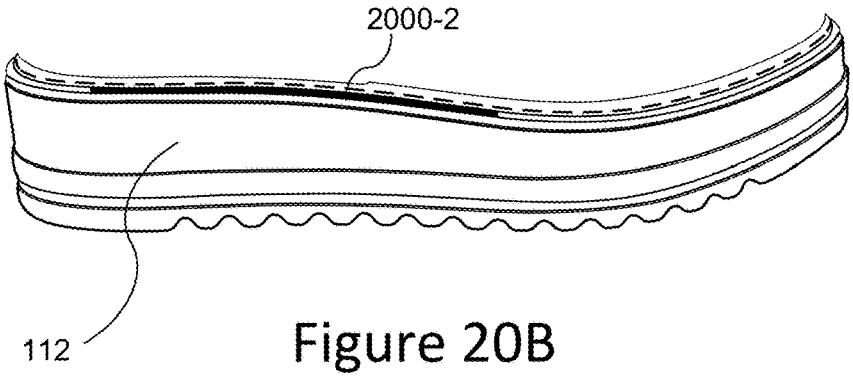
Figure 20C:
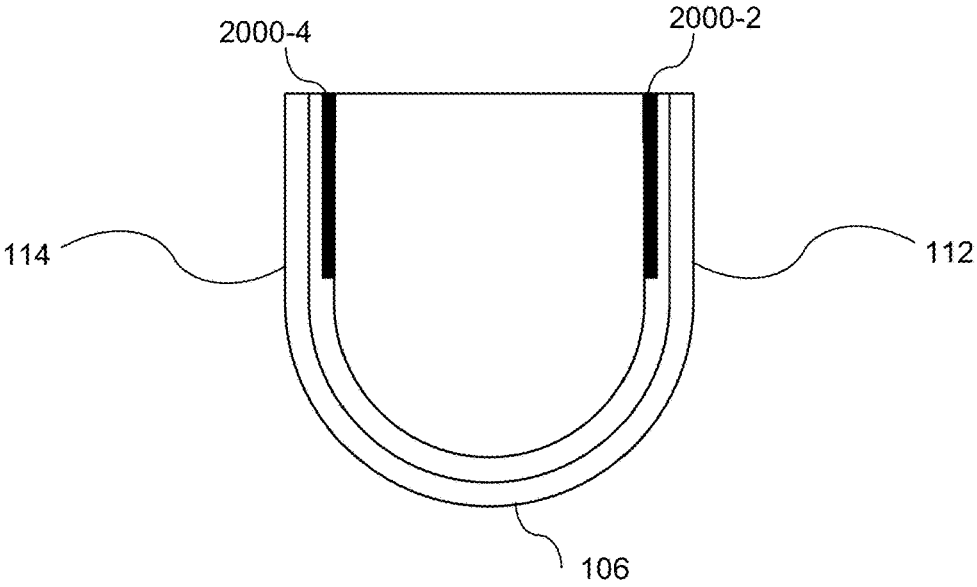

FIGS. 20A-20C illustrate an exemplary right shoe in accordance with some embodiments. FIG. 20A is aerial top view of base top surface 122 including a right channel 2000-2 and a left channel 2000-4 (e.g., channel 701). The right and left channels 2000-2, 2000-4 allow the sliders (e.g., 620 or 820) of the detachable panels to secure to the base right side 112 and base left side 114, respectively. Channels 2000-2 and 2000-4 may optionally include stopping mechanisms on either side of the counter 118 to stop the sliders of the detachable panels from sliding backwards beyond the rear of the channel (i.e., so that they can only be slid onto or off from the front of the channel).

Figure 21A:
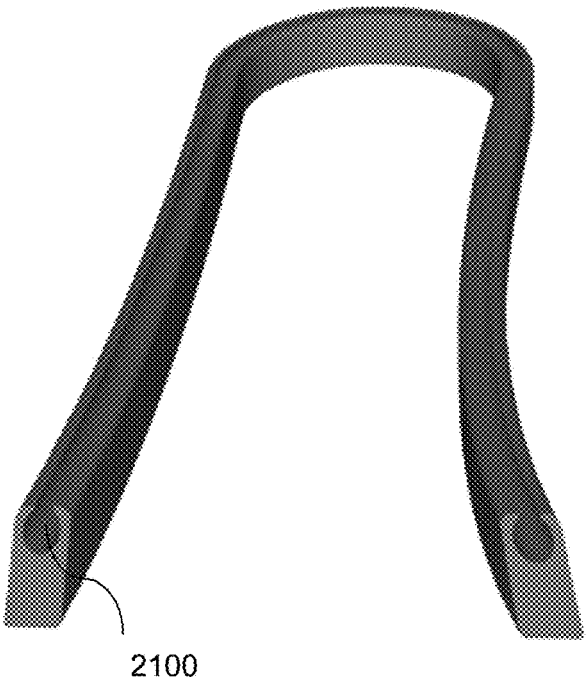
FIGS. 21A-21B illustrate an exemplary attachment structure for the footwear in accordance with some embodiments.
Figure 21B:
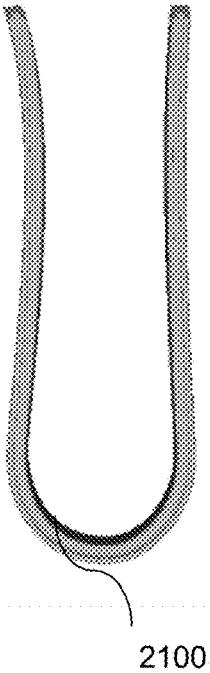

FIGS. 21A and 21B illustrate different views of a section of an exemplary channel 2100 (e.g., channel 2000-2 and 2000-4). Channel 2100 attaches to footwear 100 to detachably connect detachable panels to footwear 100. FIG. 21A is an oblique aerial view of the channel and FIG. 21B is a top view of the channel. For example, FIGS. 21A-21B are component views of 2000-2 and 2000-4 of FIGS. 20A-20C. In some embodiments, channel 2100 is made of metal, plastic, and/or any other suitable materials. The channel 2100 has a circular groove formed in it for receiving a corresponding keyed slider, as described below.

Figure 22:
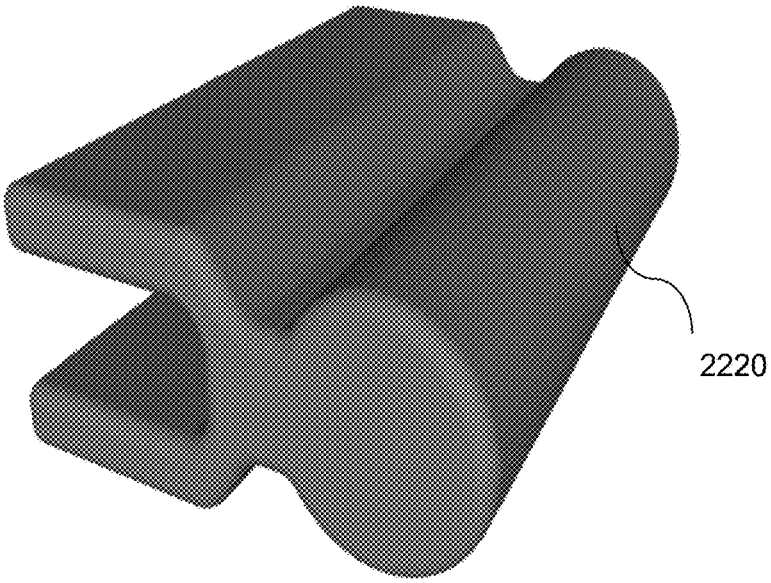
FIGS. 22-24B illustrates an exemplary attachment structure for the detachable footwear panels in accordance with some embodiments.

FIG. 22 illustrates a portion of an exemplary slider 2220 in accordance with some embodiments. In some embodiments, one end of the illustrated slider 2220 attaches to any of the embodiments of the detachable panel discussed herein, (e.g., detachable panel 1000, 1100, 1200, 4000, 5000, 6000, and 8000), while the other end is configured to be received within a corresponding or keyed channel 2100, as described above.

Figure 23A:
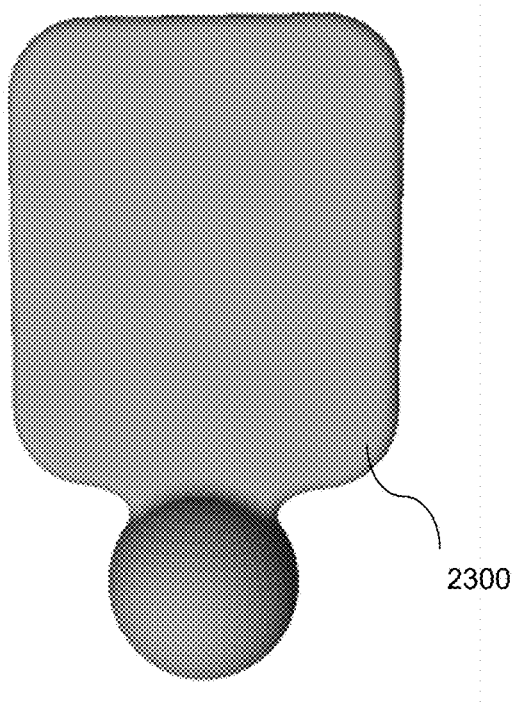
Figure 23B:
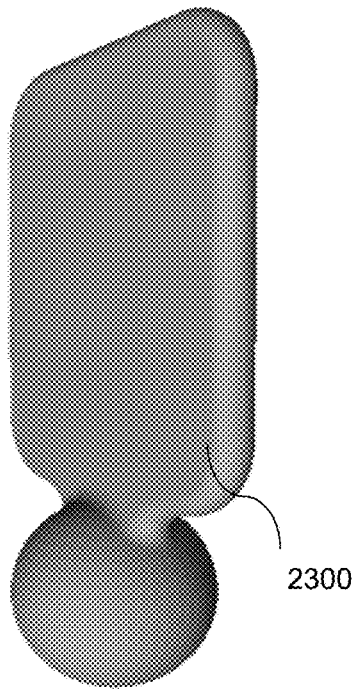
Figure 24A:
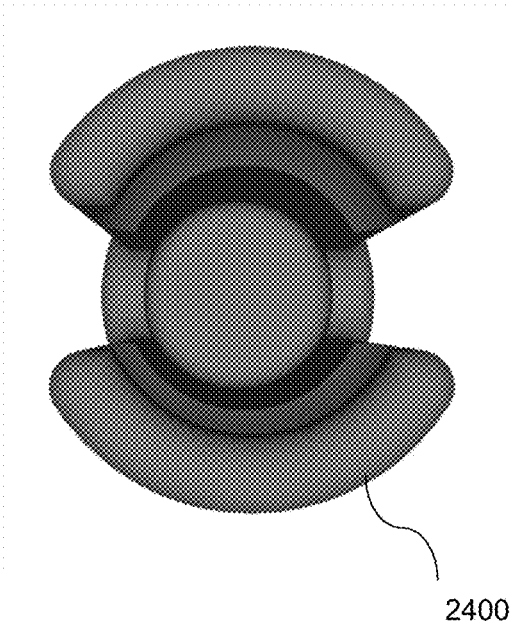
Figure 24B:
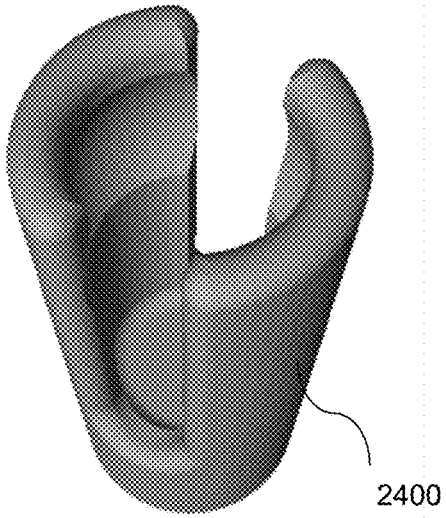

FIGS. 23A-23B illustrate another exemplary hardware component in accordance with some embodiments. The detachable panel may include connection mechanisms, such as that shown in FIGS. 23A-23B. FIGS. 24A-24B illustrate exemplary hardware components for footwear 100. Male connection mechanism 2300 (FIGS. 23A-23B) is configured to snap into receiving female connection mechanism 2400 wherever a secure connection between a panel and footwear is required. As descried herein, hardware components 2300 and/or 2400 may be made of metal, plastic, and/or any other suitable materials.

Figure 25:
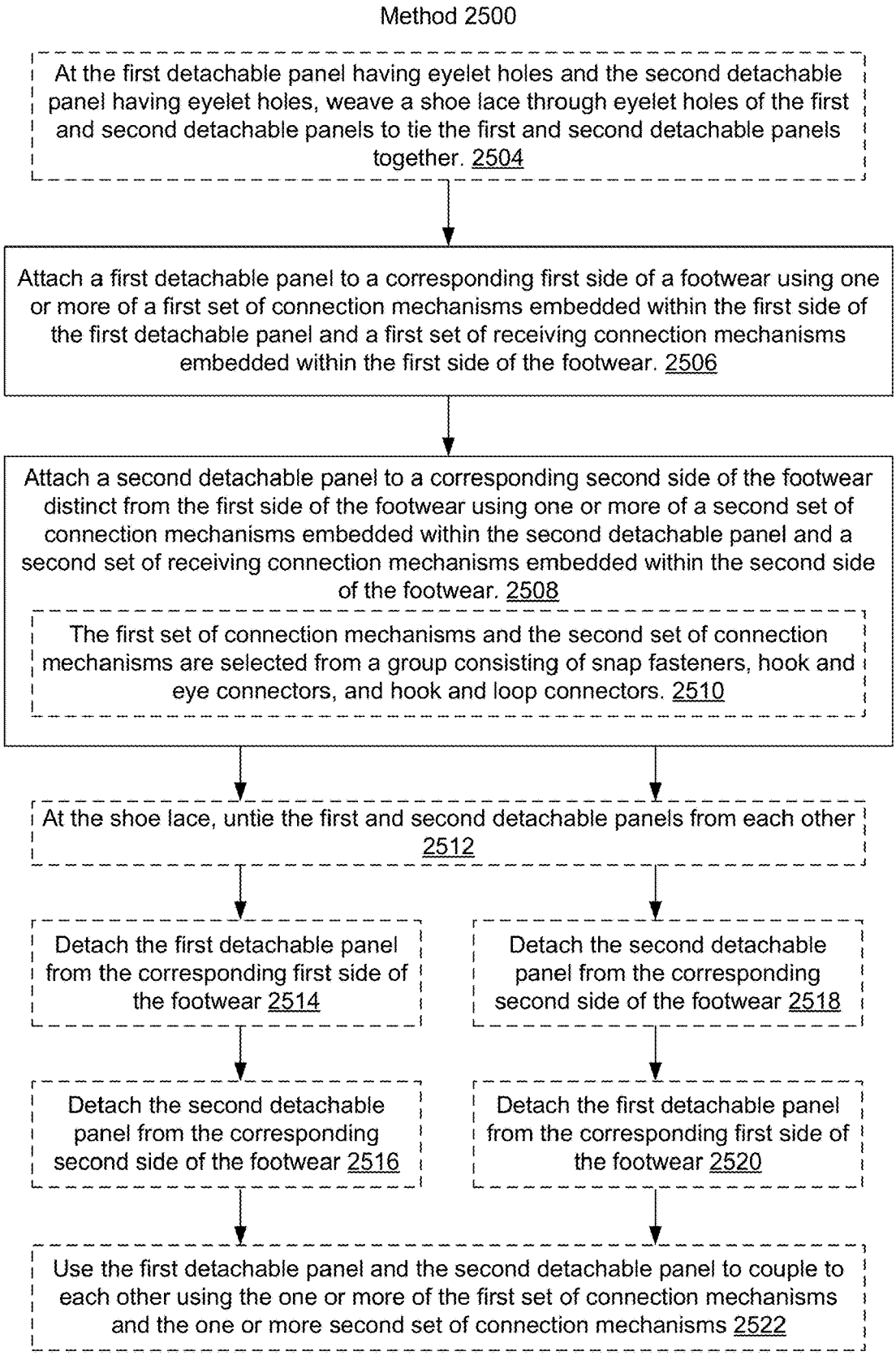
FIG. 25 is a flow diagram illustrating a method of swapping the footwear panels in accordance with some embodiments.

FIG. 25 is a flow diagram illustrating a method 2500 of swapping panels on footwear in accordance with some embodiments.

In some embodiments, at a first detachable panel (e.g., detachable right panel 142) having eyelet holes and a second detachable panel (e.g., detachable left panel 140) having eyelet holes, a wearer weaves 1102 a shoelace (e.g., shoelace 148) through eyelet holes of the first and second detachable panels to tie the first and second detachable panels together. The wearer, for example, weaves a shoe lace in a traditional crisscross pattern to tie the first and second detachable panels together. In some embodiments, the detachable panels may have the laces pre-attached.

The wearer attaches 2504 the first detachable panel to a corresponding first side of a footwear (e.g., footwear 100, 200, 300) using one or more of a first set of connection mechanisms (e.g., left panel connectors 240-1, **240-*n*) attached to or embedded within an inner surface of the first detachable panel and a first set of receiving connection mechanisms (e.g., connection mechanism 340-1, 340-*n***) attached to or embedded within an inner surface of the first side of the footwear.

The wearer attaches 2506 the second detachable panel to a corresponding second side of a footwear (e.g., footwear 100, 200, 300) using one or more of a second set of connection mechanisms (e.g., right panel connectors 242-1, 242-2, **242-*n***) attached to or embedded within an inner surface of the second detachable panel and a second set of receiving connection mechanisms embedded within the second side of the footwear.

In some embodiments, the first set of connection mechanisms 2510 and the second set of connection mechanisms are selected from a group consisting of snap fasteners, hook and eye connectors, and hook and loop connectors.

In some embodiments, the wearer, at the shoe lace 2512, unties the first and second detachable panels from each other by undoing the shoe lace.

The wearer detaches 2514 the first detachable panel from the corresponding first side of the footwear. The wearer detaches 2516 the second detachable panel from the corresponding second side of the footwear.

In some embodiments, the wearer detaches 2518 the second detachable panel from the corresponding second side of the footwear 100. The wearer detaches 2520 the first detachable panel from the corresponding first side of the footwear. Steps 2514-2516 and 2518-2520 may be performed interchangeably. For example, the wearer may first detach the first panel and subsequently detach the second panel, or the wearer may first detach the second panel and subsequently detach the first panel. The order of the detachment of the detachable panels may differ from the order in which the detachable panels were attached to the footwear.

In some embodiments, the wearer attaches 2522 the first detachable panel and the second detachable panel to each other using the one or more of the first set of connection mechanisms and the one or more of the second set of connection mechanisms.

The foregoing description, for purpose of explanation, has been described with reference to specific embodiments. However, the illustrative discussions above are not intended to be exhaustive or to limit the scope of the claims to the precise forms disclosed. Many modifications and variations are possible in view of the above teachings. The embodiments were chosen in order to best explain the principles underlying the claims and their practical applications, to thereby enable others skilled in the art to best use the embodiments with various modifications as are suited to the particular uses contemplated.

What is claimed is:

1. Footwear comprising:

a base comprising:

a toe portion;

a heel portion opposing the toe portion;

a base left side;

a base right side opposing the base left side;

a base bottom surface configured to engage the ground when worn by a user;

a base top surface opposing the base bottom surface, the base top surface comprising one or more channels;

a toe box permanently coupled to the toe portion of the base at the top surface;

a counter permanently coupled to the heel portion of the base at the top surface;

a left support structure permanently coupled to the base top surface between the toe box and the counter at the base left side;

a right support structure permanently coupled to the base top surface between the toe box and the counter at the base right side;

a detachably interchangeable left panel exterior to the left support structure configured to detachably connect to the base top surface via a left slider configured to slide into a corresponding channel of the one or more channels on the base top surface; and a detachably interchangeable right panel exterior to the right support structure configured to detachably connect to the base top surface via a right slider configured to slide into a corresponding channel of the one or more channels on the base top surface, wherein:

the detachably interchangeable right panel is entirely separate and distinct from the detachably interchangeable left panel; and the detachably interchangeable left panel is configured to connect to the detachably interchangeable right panel via shoe laces to form a top structure of the footwear.

2. The footwear of claim 1, wherein the detachably interchangeable left panel comprises one or more left panel connectors, and the left support structure comprises one or more complementary left panel connectors configured to removably couple to the one or more left panel connectors of the detachably interchangeable left panel.

3. The footwear of claim 2, wherein the left slider inserts into a left channel, wherein the left channel is permanently coupled to the base left side.

4. The footwear of claim 3, wherein the right support structure permanently coupled to the base top surface is integrally formed with one or more of the counter and the toe box.

5. The footwear of claim 2, wherein the detachably interchangeable right panel comprises one or more right panel connectors, and the right support structure comprises one or more complementary right panel connectors configured to removably couple to the one or more right panel connectors of the detachably interchangeable right panel.

6. The footwear of claim 5, wherein the right slider inserts into a right channel, wherein the right channel is permanently coupled to the base right side.

7. The footwear of claim 5, wherein the one or more left panel connectors, one or more complementary left panel connectors, one or more right panel connectors, and one or more complementary right panel connectors are selected from a group consisting of snap fasteners, hook and eye connectors, and hook and loop connectors.

8. The footwear of claim 1, wherein the right support structure permanently coupled to the base top surface is integrally formed with the counter and the toe box.

9. The footwear of claim 1, wherein the left support structure permanently coupled to the base top surface is integrally formed with the counter and the toe box.

10. The footwear of claim 1, wherein the left support structure coupled to the base top surface is integrally formed with one or more of the counter and the toe box.

11. The footwear of claim 1, wherein the detachably interchangeable left panel and the detachably interchangeable right panel include a plurality of eyelets configured to receive the shoe laces therethrough.

12. The footwear of claim 11, wherein the shoe laces are woven through the plurality of eyelets to connect the detachably interchangeable left panel and the detachably interchangeable right panel together.

13. The footwear of claim 1, wherein the left support structure and the right support structure include female connectors embedded within the respective support structure.

14. The footwear of claim 13, wherein the left support structure includes female connectors embedded within the left support structure and the right support structure includes male connectors embedded within the right support structure.

15. The footwear of claim 14, wherein the detachably interchangeable left panel includes male connectors embedded within the detachably interchangeable left panel, and wherein the left support structure includes female connectors embedded within the left support structure, the detachably interchangeable right panel includes female connectors embedded within the detachably interchangeable right panel, and wherein the right support structure includes male connectors embedded within the right support structure, and both the left and right detachably interchangeable panels are configured to detachably connect to the left support structure and the right support structure, respectively.

16. The footwear of claim 1, wherein the detachably interchangeable left panel and the detachably interchangeable right panel include male connectors embedded within the detachably interchangeable left panel and the detachably interchangeable right panel to detachably connect to the left support structure and the right support structure.

17. The footwear of claim 1, wherein the toe box, heel portion, counter, and the detachably interchangeable left and right panels are of the same material on an outer surface thereof.

18. The footwear of claim 1, wherein the toe box, heel portion, counter, and the detachably interchangeable left and right panels are made from different materials on an outer surface thereof.

19. The footwear of claim 1, wherein the toe box, heel portion, counter, and the detachably interchangeable left and right panels have a same pattern on an outer surface thereof.

20. The footwear of claim 1, wherein the toe box, heel portion, counter, and the detachably interchangeable left and right panels have different patterns on an outer surface thereof.

21. The footwear of claim 1, wherein:

the counter includes a left longitudinal slot defined along a left side of the counter, and a right longitudinal slot defined along a right side of the counter; and the left and right longitudinal slots each extend from an upper edge of the counter to a sole.

22. The footwear of claim 21, wherein the detachably interchangeable left panel is configured to slide a portion of the detachably interchangeable left panel into the left longitudinal slot, and the detachably interchangeable right panel is configured to slide a portion of the detachably interchangeable right panel into the right longitudinal slot.

23. The footwear of claim 1, wherein neither of the detachably interchangeable right panel or the detachably interchangeable left panel cover the toe portion.

* * * * *